US008097392B2

(12) United States Patent
Teshima et al.

(10) Patent No.: US 8,097,392 B2
(45) Date of Patent: Jan. 17, 2012

(54) LIQUID DEVELOPER AND IMAGE FORMING APPARATUS

(75) Inventors: Takashi Teshima, Shiojiri (JP); Satoru Miura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 843 days.

(21) Appl. No.: 12/167,702

(22) Filed: Jul. 3, 2008

(65) Prior Publication Data

US 2009/0023089 A1 Jan. 22, 2009

(30) Foreign Application Priority Data

Jul. 17, 2007 (JP) ..... 2007-186262
Feb. 15, 2008 (JP) ..... 2008-035327

(51) Int. Cl.
*G03G 9/13* (2006.01)

(52) U.S. Cl. ..... 430/114; 430/115

(58) Field of Classification Search ..... 430/114, 430/115

See application file for complete search history.

(56) References Cited

U.S. PATENT DOCUMENTS 4,250,241 A * 2/1981 Tsubuko et al. ..... 430/114
2007/0202431 A1* 8/2007 Miura et al. ..... 430/115

FOREIGN PATENT DOCUMENTS

JP 2002251040 A * 9/2002
JP 2006-251253 9/2006

OTHER PUBLICATIONS

English language machine translation of JP 2002-251040 (Sep. 2002).*

* cited by examiner

*Primary Examiner* — Christopher Rodee
(74) *Attorney, Agent, or Firm* — DLA Piper LLP (US)

(57) ABSTRACT

A liquid developer includes an insulation liquid containing a fatty acid monoester and toner particles comprised of a resin material. The resin material is characterized in that a weight-average molecular weight Mw of the resin material is in the range of 20,000 to 200,000, and an amount of a component of which molecular weight M is 10,000 or less contained in the resin material is in the range of 5 to 40 wt %. The liquid developer described above is harmless to the environment. Further, the liquid developer also has superior preservability or storage stability and superior fixing characteristics at a low temperature. An image forming apparatus that can suitably use such a liquid developer is also provided.

8 Claims, 6 Drawing Sheets

LIQUID DEVELOPER AND IMAGE FORMING APPARATUS

BACKGROUND

1. Technical Field

The present invention relates to a liquid developer and an image forming apparatus, and in particular relates to a liquid developer and an image forming apparatus that can use the liquid developer.

2. Related Art

As a developer used for developing an electrostatic latent image formed on a latent image carrier, there are known two types. One type of such a developer is known as a dry toner which is formed of a material containing a coloring agent such as a pigment or the like and a binder resin, and such a dry toner is used in a dry condition thereof.

The other type of such a developer is known as a liquid developer (liquid toner) which is obtained by dispersing toner particles into a carrier liquid having electric insulation properties (one example of such a liquid developer is disclosed in JP-A 2006-251253).

In the developing method using such a dry toner, since a solid state toner is used, there is an advantage in handleability thereof. On the other hand, however, this method involves problems in that an adverse effect against a human body is likely to be caused by toner powder, contamination is likely to occur by dispersal of toner powder, and toner particles are likely to be massed together in a cartridge.

Further, in such a dry toner, since aggregation of toner particles is likely to occur in the producing process thereof, it is difficult to obtain toner particles each having a sufficiently small uniform diameter. This means that it is difficult to form a toner image having high resolution.

Furthermore, there is also a problem in that when the size of the toner particle is made to be relatively small, the problems resulted from the powder form of the dry toner described above become more serious.

On the other hand, in the developing method using the liquid developer, since aggregation of toner particles in the liquid developer is effectively prevented, it is possible to use very fine toner particles and it is also possible to use a binder resin having a lower softening point (a low softening temperature).

As a result, the method using the liquid developer has such advantages as good reproducibility of an image composed of thin lines, good tone reproducibility as well as good reproducibility of colors. Further, the method using the liquid developer is also superior as a method for forming an image at high speed.

However, in the conventional liquid developer an insulation liquid contained in the liquid developer has low affinity to the toner particles, and thus it is difficult for the liquid developer to maintain the good dispersing state of the toner particles in the liquid developer for a long period of time. As a result, it is difficult to sufficiently maintain preservability or storage stability of the liquid developer for a long period of time.

Additionally, in view of the energy saving trend of recent years, liquid developers are required to have fixing characteristics at a relatively low temperature. However, in the currently available liquid developers, there is a problem in that offsets (low temperature offsets) are likely to occur in fixing at a low temperature.

SUMMARY

Accordingly, it is an object of the present invention to provide a liquid developer which is harmless to an environment and has superior preservability or storage stability as well as superior fixing characteristics at a low temperature. Further, it is also an object of the present invention to provide an image forming apparatus that can suitably use such a liquid developer.

These objects are achieved by the present invention described below.

In a first aspect of the present invention, there is provided a liquid developer which comprises an insulation liquid containing a fatty acid monoester and toner particles comprised of a resin material, and the resin material containing a component of which molecular weight M is 10,000 or less, wherein the resin material is characterized in that, a weight-average molecular weight Mw of the resin material is in the range of 20,000 to 200,000, and an amount of the component contained in the resin material is in the range of 5 to 40 wt %.

In the liquid developer according to the present invention, it is preferred that when the weight-average molecular weight of the resin material is defined as Mw and a number-average molecular weight of the resin material is defined as Mn, Mw/Mn which is an index of a molecular weight distribution of the resin material is in the range of 1.4 to 40.

In the liquid developer according to the present invention, it is also preferred that the resin material has ester bonds in its chemical structure.

In the liquid developer according to the present invention, it is also preferred that the fatty acid monoester is comprised of a fatty acid component and an alcohol component which is reacted with the fatty acid component, wherein the fatty acid component contains a saturated fatty acid monoester of which carbon number is in the range of 8 to 20.

In the liquid developer according to the present invention, it is also preferred that a carbon number of the alcohol component is in the range of 1 to 4.

In the liquid developer according to the present invention, it is also preferred that an amount of the fatty acid monoester contained in the insulation liquid is in the range of 10 to 60 wt %.

In the liquid developer according to the present invention, it is also preferred that further comprising a polymer dispersant.

In the liquid developer according to the present invention, it is also preferred that the polymer dispersant is represented by the following general formula (I),

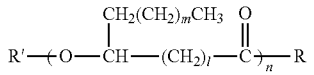

(I)

where l is an integer in the range of 9 to 12, m is an integer in the range of 3 to 6, n is an integer in the range of 5 to 8, R represents —OH, R' represents H— or $CH_3(CH_2)_pCO$—, and p is an integer in the range of 15 to 18.

In the liquid developer according to the present invention, it is also preferred that an amount of the polymer dispersant contained in the liquid developer is in the range of 1.0 to 10.0 parts by weight with respect to the toner particles of 100 parts by weight.

In a second aspect of the present invention, there is provided a liquid developer which comprises an insulation liquid containing a fatty acid monoester and toner particles comprised of a resin material, and the resin material containing a component of which molecular weight M is 10,000 or less, wherein in the case where a part of the toner particles is taken out from the liquid developer, a weight-average molecular weight Mw of the resin material and an amount of the component are obtained by the following steps, the steps comprising subjecting the resin material contained in the part of the toner particles to a size exclusion chromatography to obtain a chromatogram and an integral distribution curve of the molecular weight of the resin material, the chromatogram having at least one peak, and the integral distribution curve plotted using a graph in which the ordinate axis represents a relative amount (0%) of the resin material with respect to the total amount of the resin material (100%) and the abscissa axis represents the weight-average molecular weight Mw (log) of the resin material, analyzing the at least one peak of the obtained chromatogram to obtain a first result which shows that the at least one peak is a peak corresponding to the resin material of which weight-average molecular weight Mw is in the range of 19,000 to 195,000, and analyzing the obtained integral distribution curve to obtain a second result which shows that the amount of the component contained in the resin material is in the range of 5 to 40 wt %.

In a third aspect of the present invention, there is provided an image forming apparatus, comprising a plurality of developing sections for forming a plurality of monochromatic color images using a plurality of liquid developers of different colors, an intermediate transfer section to which the plurality of monochromatic color images formed by the developing sections are sequentially transferred to form an intermediate transfer image which is formed by overlaying the transferred monochromatic color images one after another, a secondary transfer section for transferring the intermediate transfer image onto a recording medium to form an unfixed image onto the recording medium, and a fixing device for fixing the unfixed image onto the recording medium, wherein each of the plurality of liquid developers of different colors comprises an insulation liquid containing a fatty acid monoester and toner particles comprised of a resin material, and the resin material containing a component of which molecular weight M is 10,000 or less, wherein a weight-average molecular weight Mw of the resin material is in the range of 20,000 to 200,000 and an amount of the component contained in the resin material is in the range of 5 to 40 wt %.

In the liquid developer according to the present invention, it is preferred that each of the plurality of developing sections includes an application roller, a supply section for supplying the liquid developer onto the application roller to form the monochromatic color images, a collecting section for collecting an excess liquid developer in the supply section, and a partition provided between the supply section and the collecting section, and wherein the excess liquid developer is collected into the collecting section over the partition.

According to the present invention as described above, it is possible to provide a liquid developer which is harmless to an environment. Further, it is also possible to provide a liquid developer which has superior preservability or storage stability as well as superior fixing characteristics at a low temperature. Furthermore, it is also possible to provide an image forming apparatus that can suitably use such a liquid developer.

DESCRIPTION OF EXEMPLARY EMBODIMENTS

Figure 1:
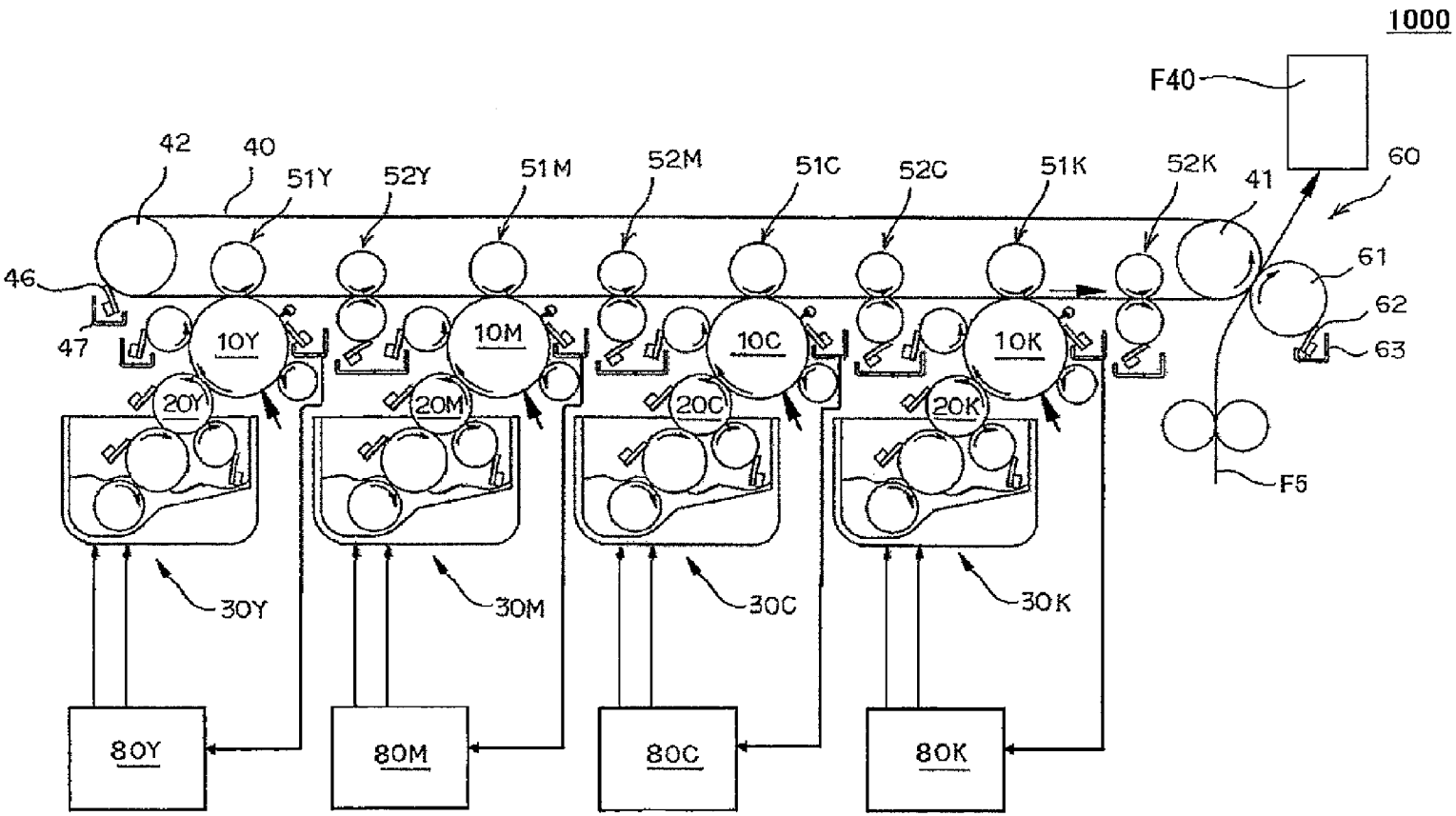
FIG. 1 is a schematic view which shows a first embodiment of an image forming apparatus to which a liquid developer of the present invention can be used.

Hereinbelow, with reference to the accompanying drawings, preferred embodiments of a liquid developer and an image forming apparatus according to the present invention will be described in details.

Liquid Developer

A liquid developer of the present invention includes an insulation liquid and toner particles dispersed in the insulation liquid. The toner particles are mainly comprised of a resin material.

Such a liquid developer contains a fatty acid monoester as a component of the insulation liquid and the toner particles comprised of the resin material as described above as a constituent component.

Generally, it is difficult for a liquid developer to exhibit both superior preservability or storage stability and superior fixing characteristics at a low temperature. However, according to the liquid developer of the present invention, it is possible to provide the liquid developer which can exhibit both superior preservability or storage stability and superior fixing characteristics at a low temperature.

Hereinbelow, each component constituting the liquid developer according to the invention will be described in details.

Toner Particles

Hereinbelow, a description will be made with regard to the toner particles.

Constituent Material of Toner Particles (Toner Material)

The toner particles (toner) contained in the liquid developer of the present invention are mainly constituted of a resin material.

1 Resin Material

The liquid developer according to the invention contains the toner particles constituted of the resin material. A weight-average molecular weight Mw of such a resin material is in the range of 20,000 to 200,000, but the resin material also contains a component of which molecular weight M is 10,000 or less, and an amount of the component contained in the resin material is in the range of 5 to 40 wt %.

Such a resin material has sufficiently high weight-average molecular weight Mw. The toner particles constituted of such a resin material as the constituent component are sufficiently dispersed in the insulation liquid contained (fatty acid monoester) in the liquid developer. In such a state, it is difficult for the fatty acid monoester to enter into the resin material due to the high weight-average molecular weight Mw thereof.

As a result, it becomes difficult that the resin material is plasticized in the insulation liquid. Thus, even if the toner particles are in contact with each other in the insulation liquid, it is possible to prevent the toner particles from aggregating or fusing (joining together) in the insulation liquid reliably.

Further, the resin material also contains the component (resin component) of which molecular weight M is 10,000 or less (hereinafter, simply referred to as "component" on occasion) and such a component can be fused with a relatively low amount of heat. Therefore, it is possible to fix the toner particles onto a recording medium at a low temperature.

In this regard, it is to be noted that a component of which molecular weight M is higher than 10,000 contained in the resin material is simply referred to as "high molecular resin component" in this specification.

Furthermore, the liquid developer contains the toner particles which are constituted of the resin material satisfying the conditions described above as the constituent component and the insulation liquid which contains the fatty acid monoester as described later. Such a liquid developer has superior effects as follows.

As described later, the fatty acid monoester has an effect capable of plasticizing the resin material constituting the toner particles (plasticizing effect). That is to say, in such a liquid developer, the fatty acid monoester enters into the resin material constituting the toner particles to thereby plasticize the resin material (toner particles).

In this regard, it is to be noted that the component of which molecular weight M is 10,000 or less is easily plasticized by the fatty acid monoester due to the relatively low molecular weight. On the other hand, however, it is difficult for the fatty acid monoester to plasticize the high molecular resin component due to the relatively high molecular weight thereof.

As described above, the resin material constituting the toner particles has the sufficiently high weight-average molecular weight, but the resin material also includes the component of which molecular weight M is 10,000 or less in the amount as described above. The component has a relatively lower glass transition temperature than a glass transition temperature of the high molecular resin component.

Therefore, even if such toner particles are plasticized by the fatty acid monoester due to the presence of the component, when the toner particles are in contact with each other in the insulation liquid, it is possible to prevent the toner particles from aggregating or fusing (joining together) in the insulation liquid reliably due to the presence of the high molecular resin component.

As a result, the liquid developer can exhibit superior preservability or storage stability.

In particular, even if the liquid developer is stored at a high temperature, it is also possible to reliably prevent aggregation or fusion among the toner particles due to the high molecular resin component. As a result, the liquid developer can also exhibit superior preservability or storage stability at a high temperature.

During the fixing process, the component of which molecular weight M is 10,000 or less is a component which can be fused at a relatively low temperature. Further, the component is plasticized by the fatty acid monoester as described above, thereby retaining the fatty acid monoester in the toner particles. Therefore, it is possible to reduce an amount of heat necessary to fuse the component. As a result, it is possible to reliably fix the toner particles onto a recoding medium at the low temperature.

Further, since it is possible to reduce the amount of the heat necessary to fuse the component, the obtained liquid developer can be reliably used to an image formation at a high speed.

As described above, the liquid developer of the present invention is characterized in that the resin material constituting the toner particles satisfies the weight-average molecular weight Mw and the amount of the component as described above. The liquid developer is also characterized in that the fatty acid monoester is contained in the liquid developer as a constituent component of the insulation liquid. This makes it possible to obtain excellent effects described above.

In contrast, a liquid developer which does not have such characteristics as described above can not exhibit the excellent effects described above.

If the weight-average molecular weight Mw of the resin material constituting the toner particles is smaller than the lower limit value described above, there are problems as follows.

That is to say, if the fatty acid monoester enters into the resin material having such a weight-average molecular weight, a glass transition temperature of the resin material is lowered excessively.

Therefore, when the toner particles are in contact with each other in the insulation liquid, the toner particles constituted of such a resin material easily aggregate or fuse (join together) in the insulation liquid due to impregnation of the fatty acid monoester to the resin material. As a result, it is impossible for the liquid developer to exhibit superior preservability or storage stability reliably.

If images are formed by using the liquid developer containing such toner particles, the toner particles are fixed onto a recording medium in a state that the toner particles aggregate therebetween. Therefore, it is impossible to obtain clear toner images. Additionally, the fixed toner particles are easily peeled off from the recording medium, so that it is difficult to form the toner images exhibiting superior fixing strength.

On the other hand, if the weight-average molecular weight Mw of the resin material exceeds the upper limit value described above, it is possible to reliably prevent the toner particles from aggregating or fusing therebetween due to difficult impregnation of the fatty acid monoester to the resin material.

Further, even if a small amount of the fatty acid monoester enters into the component of which molecular weight M is 10,000 or less contained in the toner particles, it is impossible to uniformly plasticize the whole toner particles due to the small amount of the fatty acid monoester. As a result, it is impossible to obtain the plasticizing effect by the fatty acid monoester sufficiently so that it is difficult to fix the toner particles onto a recording medium at a low temperature.

Further, if the amount of the component of which molecular weight M is 10,000 or less contained in the resin material is smaller than the lower limit value described above, it is impossible to reliably impregnate the fatty acid monoester into the toner particles.

Therefore, it is difficult to plasticize the toner particles sufficiently, and therefore a large amount of heat energy is required to fix the toner particles onto a recording medium. As a result, it is difficult to fix the toner particles onto a recording medium at a low temperature. Even if the toner particles are fixed onto the recording medium at a high temperature, it is difficult to form toner images exhibiting sufficient and stable fixing strength reliably.

On the other hand, if the amount of the component of which molecular weight M is 10,000 or less contained in the resin material exceeds the upper limit value described above, it is possible to fix the toner particles onto a recording medium at a low temperature due to the plasticizing effect of the component. On the other hand, however, since too much fatty acid monoester enters into the component to thereby plasticize the component excessively, the toner particles aggregate or fuse therebetween during the preservation of the liquid developer.

As a result, it is impossible to obtain the liquid developer exhibiting sufficient preservability or storage stability. In this case, even if the toner particles containing such a component are subjected to a beads mill to disassociate or crush to thereby uniform the particle size thereof, it is difficult to shear aggregated toner particles by sufficient shear force due to plasticized toner particles, which results in an additional cost.

The weight-average molecular weight Mw of such a resin material is preferably in the range of 20,000 to 200,000, more preferably in the range of 30,000 to 150,000, and even more preferably in the range of 45,000 to 120,000. This makes it possible to reliably exhibit superior preservability or storage stability of the toner particles as described above. Further, since the fatty acid monoester enters into the resin material to thereby plasticize the resin material, it is possible to reliably fix the plasticized toner particles onto a recording medium at a low temperature.

Therefore, such a liquid developer can form images at a high speed reliably. Further, it is also possible to improve adhesion between the fixed toner particles and the recording medium and weather resistance of the toner images. As a result, it is possible to exhibit superior durability of the finally obtained toner images.

The amount of the component of which molecular weight M is 10,000 or less contained in such a resin material is preferably in the range of 5 to 40 wt %, more preferably in the range of 10 to 35 wt %, and even more preferably in the range of 20 to 30 wt %.

Since this makes it possible to impregnate the fatty acid monoester in the component reliably, it is possible to plasticize the component constituting the toner particles more reliably.

Further, it is possible to reliably prevent such plasticized toner particles from aggregating or fusing therebetween due to high molecular resin component. As a result, it is possible for the liquid developer to exhibit the superior preservability or storage stability and the superior fixing characteristics at a low temperature.

Furthermore, in the case where the toner particles contain the resin material as described above and a coloring agent as described below, it is possible to disperse the coloring agent in the resin material of the toner particles uniformly. As a result, the toner images to be formed can be made clear.

In the present invention, after a predetermined time has been elapsed since the production of the liquid developer, a part of toner particles is taken out from the liquid developer which is produced using the toner particles containing the resin material as described above. Then, the resin material contained in the part of toner particles is subjected to a size exclusion chromatography to obtain a chromatogram and an integral distribution curve of the molecular weight of the resin material. Thereafter, the chromatogram is analyzed, and the integral distribution curve of the molecular weight of the resin material is also analyzed. As a result, the resin material satisfies the following parameters.

First, the part of toner particles is taken out from the liquid developer. Next, the resin material contained in the part of toner particles is subjected to the size exclusion chromatography to obtain the chromatogram having at least a peak and the integral distribution curve of the molecular weight of the resin material.

The integral distribution curve is plotted using a graph in which the ordinate axis represents a relative amount (%) of the resin material with respect to the total amount of the resin material (100%) and the abscissa axis represents the weight-average molecular weight Mw (log) of the resin material.

Then, the peak of the obtained chromatogram is analyzed to obtain a result. The result shows that the peak is a peak corresponding to the resin material of which weight-average molecular weight Mw is in the range of 19,000 to 195,000.

Further, the obtained integral distribution curve is also analyzed to obtain a result. The result shows that the amount of the component molecular weight M is 10,000 or less is in the range of 5 to 40 wt %.

In this way, the component having a relatively low molecular weight M is contained in the resin material constituting the toner particles in the liquid developer. Further, it is easy that the fatty acid monoester plasticizes the component having the low molecular weight as described above. Therefore, the resin material, particularly the component contained in the resin material is reliably plasticized in the liquid developer.

A component having a relatively high weight-average molecular weight Mw (high molecular resin component) is contained in the resin material constituting the toner particles in the liquid developer. Further, it is difficult that the fatty acid monoester plasticizes the high molecular resin component as described above.

Therefore, it is easy to maintain the shape of the toner particles due to the difficult plasticization of the high molecular resin component. Therefore, it is possible to prevent or suppress the aggregation or fusion of the toner particles when the toner particles make contact with each other in the liquid developer.

As described above, the part of toner particles is taken out from the liquid developer, and then, the resin material contained in the part of toner particles is subjected to the size exclusion chromatography to obtain the chromatogram. Thereafter, the peak of the obtained chromatogram is analyzed to obtain the result of the weight-average molecular weight Mw of the resin material.

At this time, the obtained result, namely the weight-average molecular weight Mw of the resin material is not particularly limited as long as the weight-average molecular weight Mw falls within the above noted range. However, the weight-average molecular weight Mw of the resin material is preferably in the range of 29,000 to 140,000, and more preferably in the range of 43,000 to 110,000. This makes it possible to exhibit the effects as described above conspicuously.

As described above, the part of toner particles is taken out from the liquid developer and then, the resin material contained in the part of toner particles is subjected to the size exclusion chromatography to obtain the integral distribution curve of the molecular weight of the resin material. Thereafter, the obtained integral distribution curve is analyzed to obtain the result of the amount of the component of which molecular weight M is 10,000 or less.

At this time, the obtained result, namely the amount of the component is not particularly limited as long as the amount of the component falls within the above noted range. However, the amount of the component is preferably in the range of 12 to 38 wt %, and more preferably in the range of 23 to 33 wt %.

As described above, the weight-average molecular weight Mw of the resin material to be used as a constituent material of the toner particles is different from the weight-average molecular weight Mw of the resin material contained in the part of toner particles which is taken out from the produced liquid developer. Further, the amount of the component contained in the resin material to be used as a constituent material of the toner particles is different from the amount of the component contained in the part of toner particles which is taken out from the produced liquid developer.

This is supposed to result from the reason that the resin material is decomposed by an acid component which is separated from a part of the fatty acid monoester or a part of the resin material (e.g. the component) is dissolved into the insulation liquid.

As described above, the resin material contained in the part of toner particles is subjected to the size exclusion chromatography to obtain the chromatogram having at least one peak and the integral distribution curve of the molecular weight of the resin material. However, the resin material may be subjected to a gel permeation chromatography (GPC) to obtain a chromatogram having at least one peak and the integral distribution curve of the molecular weight of the resin material.

In this case, a weight-average molecular weight Mw of the resin material corresponding to the one peak is obtained by using a retention time thereof and a calibration curve which is plotted by using a standard material preliminarily.

Examples of the standard material to be used in plotting the calibration curve include polystylene and the like.

An amount of the component of which molecular weight is 10,000 or less is obtained by using the integral distribution curve.

In this regard, it is to be noted that the weight-average molecular weight Mw of the resin material and the amount of the component are obtained as described below.

In the present invention, the resin material (binder resin) is not particularly limited as long as the parameters (the weight-average molecular weight Mw and the amount of the component of which molecular weight M is 10,000 or less and the like) as described above are satisfied. Any commonly used resin can be used as the resin material.

However, it is preferred that such a resin material has ester bonds in a chemical structure thereof. The toner particles constituted of the resin material having such ester bonds have high affinity to the insulation liquid. This is because the chemical structure of the resin material is similar to a chemical structure of the fatty acid monoester as described later.

Therefore, it is also possible to exhibit dispersibility of the toner particles in the liquid developer reliably. As a result, it is possible to prevent aggregation between the toner particles during the preservation of the liquid developer more efficiently, thereby reliably exhibiting preservability or storage stability of the liquid developer.

Furthermore, the toner particles containing such a resin material can retain the fatty acid monoester which has entered into the resin material reliably. Therefore, it is possible to plasticize the resin material reliably. This makes it possible to exhibit superior fixing characteristics at a low temperature more reliably.

Examples of the resin material having the ester bonds in the chemical structure thereof include a polyester resin, a stylene-acrylate ester co-polymer, stylene-methacrylate ester co-polymer and the like. Among these materials mentioned above, the polyester resin is preferable due to its high transparency. Therefore, in the case where the polyester resin is also used as a binder resin, color development of an obtained image becomes excellent. In this regard, it is to be noted that such a polyester resin is a condensation between diol and dicarboxylic acid.

In the case where, the weigh-average molecular weigh of such a resin material is defined as Mw and a number-average molecular weigh of such a resin material is also defined as Mn, Mw/Mn shows an index of a molecular weight distribution of the resin material. In this case, the index Mw/Mn is preferably in the range of 1.4 to 40, more preferably in the range of 1.5 to 30, and even more preferably in the range of 1.6 to 25.

According to the invention, the resin material constituting the toner particles has such a relation between Mw and Mn, namely the index Mw/Mn. Therefore, the toner particles can contain a resin component having a relatively low molecular weight (component) and a resin component having a relatively high molecular weight (high molecular resin component) in a balanced manner.

The resin component having a relatively high molecular weight contributes mainly to preservability or storage stability of the liquid developer and fixing strength of the toner particles. The resin component having a relatively low molecular weight contributes mainly to fixing characteristics at a low temperature. As a result, it is possible to reliably exhibit both fixing characteristics at a low temperature and superior preservability or storage stability of the liquid developer.

A glass transition temperature Tg of the resin material constituting the toner particles is preferably in the range of 35 to 60° C., and more preferably in the range of 40 to 55° C. If the resin material of which glass transition temperature Tg falls within the above noted range is used as a constituent material of the toner particles, it is possible to reliably prevent or suppress aggregation and fusion between the toner particles during the preservation of the liquid developer.

As a result, it is possible to exhibit superior preservability or storage stability of the liquid developer. Furthermore, it is also possible to fix the toner particles onto a recording medium at a low temperature reliably.

A softening point Tf of the resin material constituting the toner particles is preferably in the range of 60 to 180° C., and more preferably in the range of 80 to 120° C. If the first resin component of which the softening point Tf falls within the above noted range is used as the constituent material of the toner particles, it is possible to reliably prevent or suppress aggregation and fusion between the toner particles during the preservation of the liquid developer.

As a result, it is possible to exhibit superior preservability or storage stability of the liquid developer. Further, during fixing process it is also possible to fuse the toner particles with a small amount of heat. This makes it possible to fix the toner particles onto a recording medium at a low temperature reliably. Furthermore, such a liquid developer can also be used for forming images at a high speed reliably.

In this specification, it is to be noted that the term "glass transition temperature Tg" means a temperature obtained as follows.

A sample, namely the resin material is subjected to a differential scanning calorimetry apparatus DSC-220C (manufactured by Seiko Instruments Inc.) under conditions that a sample amount is 10 mg, a temperature raising speed is 10° C./min and a measurement temperature range is in the range of 10 to 150° C. to obtain a chart. Then, an extended line of a base line to the glass transition temperature in the obtained chart is crossed with a tangent which represents a maximal slop in a curve from a point at which a heat capacity of the sample suddenly changes in the chart to a vertex of a peak of the curve to obtain an intersection point of the tangent and the extended line. The glass transition temperature Tg is a temperature at the intersection point.

In this regard, it is to be noted that this description can be applied to a glass transition temperature (ΔTg) as described below.

In this specification, the term "softening point" means a temperature at which softening is begun under the conditions that a temperature raising speed is 5° C./mim and a diameter of a die hole is 1.0 mm in a high-floored flow tester (manufactured by Shimadzu Corporation).

2 Coloring Agent

The toner particles of the liquid developer may contain a coloring agent. As for a coloring agent, it is not particularly limited, but pigments, dyes or the like can be used.

3 Other Components

In the toner particles, other components other than the above components may be contained. Examples of such other components include wax, magnetic powder, and the like.

Further, the toner material (constituent material of the toner particles) may further contain zinc stearate, zinc oxide, cerium oxide, silica, titanium oxide, iron oxide, fatty acid, or fatty acid metal salt, or the like in addition to the components described above.

Shape of Toner Particles

It is preferred that the toner particles to be used in the liquid developer of the present invention have minute roughness on the surfaces thereof. Since toner particles have a large surface area by such a minute roughness, the fatty acid monoester described above can adhere (exist) on the surfaces of the toner particles in the liquid developer more sufficiently.

In the toner particles contained in the liquid developer, an average roundness R represented by the following formula (II) is preferably in the range of 0.94 to 0.99, and more preferably in the range of 0.96 to 0.99.

$$R=L_0/L_1 \quad \text{(II)}$$

wherein $L_1$ (μm) represents the circumference of a projected image of a toner particle that is a subject of measurement, and $L_0$ (μm) represents the circumference of a perfect circle (a geometrically perfect circle) having the same area as that of the projected image of the toner particle that is a subject of measurement.

If the average roundness R of the toner particles falls within the above noted range, it is possible to contain an appropriate amount of the insulation liquid in unfixed toner images transferred onto the recording medium, thereby enabling fixing characteristics of the toner particles to be improved.

An average particle size (diameter) of the toner particles constituted of the above described materials is preferably in the range of 0.7 to 3 μm, more preferably in the range of 0.8 to 2.5 μm, and even more preferably in the range of 0.8 to 2 μm.

If the average particle size of the toner particles is within the above range, it is possible to make properties variation of each of the toner particles small. As a result, it is possible to make resolution of a toner image formed from the liquid developer (liquid toner) sufficiently high while making the reliability of the obtaining liquid developer as a whole sufficiently high.

Further, it is also possible to improve dispersibility of the toner particles in the insulation liquid to a satisfactory level, thereby enabling the preservability or storage stability of the liquid developer to be higher.

An amount of the toner particles contained in the liquid developer is preferably in the range of 10 to 60 wt %, and more preferably in the range of 20 to 50 wt %.

Insulation Liquid

Next, a description will be made with regard to the insulation liquid.

The insulation liquid used in the present invention includes a fatty acid monoester which is an ester obtained from a fatty acid and a monovalent alcohol. Such a fatty acid monoester is represented by the following general formula (III), wherein both R and R' represent an alkyl group.

$$R—COO—R' \quad \text{(III)}$$

The fatty acid monoester used in the insulation liquid of the liquid developer of the present invention is a natural component and a component harmless to the environment.

Therefore, it is possible to decrease a load to the environment by the insulation liquid which may be caused by leakage of the insulation liquid out of the image forming apparatus and discard of the used liquid developers. As a result, it is also possible to provide a liquid developer which is harmless to the environment.

The fatty acid monoester is a liquid having a relatively low viscosity and has high affinity to the resin material as described above. Therefore, inclusion of the fatty acid monoester in the insulation liquid makes it possible to exhibit superior dispersibility of the toner particles contained in the liquid developer. As a result, it is possible to exhibit superior preservability or storage stability of the liquid developer.

Further, the fatty acid monoester has a property that can easily enter between molecular chains of the resin material constituting the toner particles. Such a fatty acid monoester which enters between the molecular chains of the resin material plasticizes the resin material contained in the toner particles. Namely, the fatty acid monoester has the plasticizing effect. This makes it possible to easily fuse the resin material containing the fatty acid monoester even at a relatively low temperature, and therefore it is possible to fix the toner particles onto a recording medium firmly.

Further, such plasticized toner particles are allowed to adhere to the recording medium due to the plasticizing effect, thereby it is possible to fix the toner particles onto the recording medium more firmly. As a result, it is possible to exhibit superior fixing characteristics of the obtained toner images.

In the case where paper is used as the recording medium, the toner particles (resin material constituting the toner particles) can enter into gaps of paper fibers of the paper easily due to the plasticizing effect.

At this time, the resin material constituting the toner particles which enter into the gaps of the paper fibers of the paper is fused by heat during the fixing process. Then, a part of the fused resin material is impregnated into the paper. In this state, the toner particles are cooled and cured to thereby exhibit an anchoring effect against the paper. As a result, it is possible to fix the toner particles onto the paper firmly. Therefore, it is possible for the liquid developer containing such toner particles to improve fixing characteristics at a low temperature. Further, it is also possible to exhibit superior fixing characteristics of the toner particles onto the recording medium, namely the paper.

A fatty acid component constituting such a fatty acid monoester is represented by the following general formula (IV), wherein R represents an alkyl group.

$$R—COOH \quad \text{(IV)}$$

Examples of such a fatty acid component include, but not limited thereto, an unsaturated fatty acid such as oleic acid, palmitoleic acid, linoleic acid, α-linolenic acid, γ-linolenic acid, arachidonic acid, docosahexaenoic acid (DHA), and eicosapentaenoic acid (EPA); a saturated fatty acid such as butyric acid, caproic acid, caprylic acod, capric acid, lauric acid, myristic acid, palmitic acid, stearic acid, arachidic acid, behenic acid, and lignoceric acid; and the like. These fatty acid components may be used singly or in combination of two or more of them.

Among the fatty acid components mentioned above, in the case where the fatty acid monoester contains the saturated fatty acid as the fatty acid component, since the saturated fatty acid does not have unsaturated bonds, deterioration (oxidation or decomposition) of the fatty acid monoester is difficult to occur. As a result, the saturated fatty acid becomes chemically stable.

Therefore, the insulation liquid containing such a fatty acid monoester prevents occurrence of deterioration such as rising viscosity, changing color, lowering electric resistance value and the like for a long period of time reliably. As a result, it becomes possible to make preservability or storage stability of the liquid developer containing the insulation liquid more excellent.

As described above, the fatty acid monoester is transferred to the paper together with the toner particles during the fixing process, so that the saturated fatty acid monoester is contained in obtained toner images.

Therefore, since the saturated fatty acid contained in the toner images is a component which is difficult to be deteriorated, even when the toner images are exposed in an external environment such as light, heat and oxygen, it is possible to prevent color of the saturated fatty acid monoester from changing reliably, and therefore the obtained toner images can maintain its clearness for a long period of time.

In the case where the fatty acid monoester contains the saturated fatty acid as the fatty acid component, it is preferred that the saturated fatty acid has 8 to 20 carbon atoms.

This makes it possible to exhibit the plasticizing effect of the fatty acid monoester against the resin material reliably, thereby enabling preservability or storage stability of the liquid developer and fixing characteristics at a low temperature of the toner particles to be more excellent.

A part of such a fatty acid monoester can remain in a recording medium with the toner particles. Even in such a case, it is possible to reliably prevent the liquid developer from deteriorating by change of an external environmental such as light (ultraviolet lay) and heat. As a result, color of the obtained toner images can be maintained with keeping its clearness for a long period of time.

Such a fatty acid monoester is an ester obtained from fatty acid and monovalent alcohol. Such an alcohol is represented by the following general formula (V), where R represents an alkyl group.

$$R—OH \quad (V)$$

It is preferred that the R of the general formula (V) is in the range of 1 to 4 carbon atoms.

By using such an alcohol, it is possible for the fatty acid monoester to impregnate into the toner particles reliably to thereby plasticize the toner particles reliably. Additionally, it is also possible to make chemical stability of the liquid developer excellent. As a result, it is possible to make preservability or storage stability of the liquid developer and fixing characteristics at a low temperature more excellent.

Further, this also makes it possible to set the viscosity of the insulation liquid appropriately so that the liquid developer can be impregnated into a recording medium suitably. Examples of such an alcohol include methanol, ethanol, propanol, butanol, isobutanol, and the like.

The fatty acid monoester may be an ester produced by an ester-exchange reaction of a vegetable oil and the monovalent alcohol as described above. In other words, the fatty acid monoester contained in the insulation liquid of the present invention may be an ester obtained from one or more of the fatty acid and one or more of the alcohol as described above.

Examples of the vegetable oil used in the ester-exchange reaction include soy oil, rape oil, dehydrated castor oil, wood oil, safflower oil, linseed oil, sunflower oil, corn oil, cotton oil, sesame oil, hemp oil, evening primrose oil, palm oil (particularly palm kernel oil), coconut oil, and the like.

An amount of the fatty acid monoester contained in the insulation liquid is preferably in the range of 10 to 60 wt %, more preferably in the range of 15 to 55 wt %, and even more preferably in the range of 30 to 50 wt %.

If the amount of the fatty acid monoester falls within above mentioned range, the amount of the fatty acid monoester contained in the insulation liquid is sufficiently high. Therefore, it becomes possible for the fatty acid monoester to have a great chance of adhering on the surfaces of the toner particles. As a result, the plasticizing effect against the toner particles due to the fatty acid monoester is achieved more effectively so that the resin material contained in the toner particles can be impregnated into the recording medium more reliably.

It is also possible to exhibit superior dispersibility of the toner particles as well as the plasticizing effect in the liquid developer. As a result, it becomes possible for the liquid developer to exhibit superior preservability or storage stability. It also becomes possible for the toner particles to exhibit superior fixing characteristics at a low temperature.

A viscosity of the fatty acid monoester is preferably 10 mPa·s or less, and more preferably 5 mPa·s or less. By setting the viscosity of the fatty acid monoester to a sufficient low range, the fatty acid monoester can be impregnated into the recording medium more effectively.

Therefore, the impregnated fatty acid monoester can more reliably drag a part of the resin material of the toner particles plasticized by the plasticizing effect and fused by heat upon fixation, and a part of the fatty acid monoester existing in the vicinity of the surfaces of the toner particles are impregnated into the recording medium. As a result, the above-mentioned anchoring effect is achieved more reliably so that the fixing characteristics of the toner particles onto a recording medium can be improved.

Further, when the liquid developer is produced by using a method as described later, it is possible to obtain toner particles having uniform particle size appropriately. In this regard, it is to be noted that in this specification, the viscosity of the liquid developer is measured according to JIS Z8809 using a vibration type viscometer at a temperature of 25° C.

The insulation liquid may contain the following liquid in addition to the fatty acid monoester as described above.

Examples of such a liquid include: a silicone oil such as KF96, KF4701, KF965, KS602A, KS603, KS604, KF41, KF54, FA630 (produced by Shin-Etsu Chemical Co., Ltd.), TSF410, TFS433, TFS434, TFS451, TSF437 (produced by Momentive Performance Materials Japan, Inc.), and SH200 (produced by TORAY INDUSTRIES, INC.); an aliphatic hydrocarbon such as ISOPER E, ISOPER G, ISOPER H, ISOPER L ("ISOPER" is a product name of Exxon Mobil Chemical), COSMO WHITE P-60, COSMO WHITE P-70, COSMO WHITE P-120 ("COSMO WHITE" is a product name of COSMO OIL LUBRICANTS Co., Ltd.), DIANA FRESIA W-8, DAPHNE OIL CP, DAPHNE OIL KP, TRANSFORMER OIL H, TRANSFORMER OIL G, TRANSFORMER OIL A, TRANSFORMER OIL B, TRANSFORMER OIL S ("DIANA FRESIA", "DAPHNE OIL" and "TRANSFORMER OIL" is a product name of Idemitsu Kosan Co., Ltd.), SHELLSOL 70, SHELLSOL 71 ("SHELLSOL" is a product name of Shell Chemical Japan Ltd.), Amsco OMS, Amsco 460 solvent ("Amsco" is a product name of Spirit Co., Ltd.), low-viscosity or high-viscosity liquid paraffin (produced by Wako Pure Chemical Industries, Ltd.), octane, isooctane, decane, isodecane, decalin, nonane, dodecane, isododecane, cyclohexane, cyclooctane, and cyclodecane; decomposition products of fatty acid triglyceride such as fatty acid triglyceride, fatty acid diglyceride, fatty acid monoglyceride, glycerin, and fatty acid; synthetic ester-based liquid such as Prifer 6813 (produced by CRODA); benzene, toluene, xylene, mesitylene, fatty acid monoester; and the like. These liquid may be used singly or in combination of two or more of them.

In the case where the insulation liquid contains the fatty acid triglyceride among the liquids mentioned above, it is possible to obtain the following effects. In this regard, it is to be noted that the fatty acid triglyceride means a triester (triglyceride) obtained from glycerin and fatty acid. That is to say, the fatty acid triglyceride has a viscosity which is relatively higher than a viscosity of the fatty acid monoester as well as high affinity to the toner particles and the fatty acid monoester as described above.

Therefore, the insulation liquid which contains the fatty acid triglyceride in addition to the fatty acid monoester has an appropriately viscosity. Therefore, it becomes possible for an appropriate amount of the fatty acid monoester to enter into the resin material of the toner particles. As a result, it is possible to plasticize the toner particles appropriately.

Further, the liquid developer containing such insulation liquid can exhibit more excellent preservability or storage stability. This is supposed to result from the following reasons. Since the insulation liquid has the appropriate viscosity in such a liquid developer as described above, it becomes possible for the toner particles to decrease a chance of contact and collision therebetween. Therefore, it is possible to prevent the toner particles from aggregating therebetween reliably. As a result, it is possible to exhibit more excellent preservability or storage stability as described above.

Furthermore, since the fatty acid monoester is a component which is harmless to environment, it is possible to decrease a load to the environment by the insulation liquid which may be caused by leakage of the insulation liquid out of the image forming apparatus and discard of the used liquid developers. As a result, it is possible to provide a liquid developer which is harmless to the environment.

An unsaturated fatty acid monoester may be contained in the fatty acid triglyceride as a fatty acid component to constitute the fatty acid triglyceride. In this case, it is possible to obtain excellent fixing strength of the toner particles onto a recording medium.

More specifically, the unsaturated fatty acid component is a component which is polymerized when oxidized (during the fixing process), and thus the unsaturated fatty acid component is a component which has a function of improving the fixing characteristics of the toner particles against a recording medium when it is cured. Due to such a function, the liquid developer of the present invention makes it possible to improve the fixing characteristics of the toner particles against a recording medium.

Furthermore, since the unsaturated fatty acid component is cured, it is possible to write letters or the like onto the fixed toner image with a ballpoint pen using a water-based ink easily and reliably.

Examples of the unsaturated fatty acid constituting such a fatty acid triglyceride include, but not limited thereto, monovalent unsaturated fatty acid such as crotonic acid, myristoleic acid, palmitoleic acid, oleic acid, elaidic acid, vaccenic acid, gadoleic acid, erucic acid, and nervonic acid; polyvalent unsaturated fatty acid such as linoleic acid, α-linolenic acid, γ-linolenic acid, arachidonic acid, eleostearic acid, stearidonic acid, clupanodonic acid, docosahexaenoic acid (DHA), and eicosapentaenoic acid (EPA); these derivatives; and the like. These unsaturated fatty acid may be used singly or in combination of two or more of them.

The above-mentioned unsaturated fatty acid triglyceride can be obtained effectively from naturally derived oils such as a vegetable oil (e.g. safflower oil, rice-bran oil, rape oil, olive oil, canola, soy oil, linseed oil, ricinus oil and the like), an animal oil (e.g. butter and the like) and the like.

A saturated fatty acid may be contained in the fatty acid triglyceride as the fatty acid component. Inclusion of the saturated fatty acid in the fatty acid triglyceride makes it possible to maintain chemical stability of the liquid developer and electrical insulation property of the insulation liquid at a more higher level.

Examples of such a saturated fatty acid as the fatty acid component include butyric acid, caproic acid, caprylic acod, capric acid, lauric acid, myristic acid, palmitic acid, stearic acid, arachidic acid, behenic acid, lignoceric acid, and the like. These saturated fatty acid may be used singly or in combination of two or more of them.

Among the saturated fatty acids mentioned above, the saturated fatty acid component having a carbon number preferably in the range of 6 to 22, more preferably in the range of 8 to 20, and even more preferably in the range of 10 to 18 is preferably used. By using such a saturated fatty acid as the fatty acid component, it is possible to exhibit the effects (that is, chemical stability of the liquid developer and electrical insulation property of the insulation liquid) as described above conspicuously.

Further, in the case where the insulation liquid contains aliphatic hydrocarbon as described above, it is possible to obtain the following effects.

Generally, the aliphatic hydrocarbon is a chemically stable liquid and has high electric resistance. Therefore, the liquid developer containing the aliphatic hydrocarbon therein has especially excellent development characteristics and transfer characteristics of the toner images, and therefore it is possible to obtain especially clear toner images having less defects and the like.

Since the aliphatic hydrocarbon is a hydrophobic compound, the aliphatic hydrocarbon is also a liquid having a low hygroscopic property. Therefore, in the case where the aliphatic hydrocarbon is used together with the fatty acid monoester as the insulation liquid, it is possible to prevent the insulation liquid from absorbing moisture during preservation of the liquid developer reliably. It is also possible to prevent the insulation liquid from denaturing (deteriorating) more reliably.

Furthermore, in the case where the insulation liquid contains the silicone oil as described above, it is possible to obtain the following effects.

Silicone oil is an organic compound having a skeleton of a siloxane bond. Generally, silicone oil has high electronic resistance. Therefore, in the case where the silicone oil is used as the constituent component of the insulation liquid, the liquid developer can have high electric resistance, so that it is possible to exhibit excellent properties such as transfer characteristics and development characteristics of the toner images.

Further, since a viscosity of the silicone oil depends on the kind of silicone oil to be used, it is possible to adjust the viscosity of the liquid developer by selecting an appropriate silicone oil.

Generally, since silicone oil is chemically stable and thus it is a substance which is less harmless to human body, it is possible to prevent the insulation liquid from deteriorating during the preservation thereof. As a result, it is possible to make preservability or storage stability of the liquid developer excellent.

Furthermore, since the silicone oil has also low adverse effect to human body, even when the liquid developer leaks out of an image forming apparatus, the liquid developer is harmless to the human body.

Further, the liquid developer (insulation liquid) of the present invention may further contain a dispersant for improving dispersion stability of the toner particles.

Examples of such a dispersant include: polymer dispersants such as polyvinyl alcohol, carboxymethylcellulose, polyethylene glycol, Solsperse (trade name of LUBRIZOL JAPAN Ltd.), polycarboxylic acid, polycarboxylate, polyacrylic acid metal salts (e.g., sodium salts and the like), polymethacrylic acid metal salts (e.g., sodium salts and the like), polymaleic acid metal salts (e.g., sodium salts and the like), acrylic acid-maleic acid copolymer metal salts (e.g., sodium salts and the like), polystyrene sulfonate metal salts (e.g., sodium salts and the like), condensation polymer of polyamine fatty acid and the like; viscosity mineral, silica, tricalcium phosphate, tristearic acid metal salts (e.g., aluminum salts and the like), distearic acid metal salts (e.g., aluminum salts, barium salts and the like), stearic acid metal salts (e.g., calcium salts, lead salts, zinc salts and the like), linolenic acid metal salts (e.g., cobalt salts, manganese salts, lead salts, zinc salts and the like), octanoic acid metal salts (e.g., aluminum salts, calcium salts, cobalt salts and the like), oleic acid metal salts (e.g., calcium salts, cobalt salts and the like), palmitic acid metal salts (e.g., zinc salts and the like), dodecylbenzenesulfonic acid metal salts (e.g., sodium salts and the like), naphthenic acid metal salts (e.g., calcium salts, cobalt salts, manganese salts, lead salts, zinc salts and the like), resin acid metal salts (e.g., calcium salts, cobalt salts, manganese salts, lead salts, zinc salts and the like).

Among the dispersants mentioned above, a dispersant containing a polymer dispersant is preferably used. In this regard, it is to be noted that the polymer dispersant is defined as a high molecule type dispersant having a weight molecular of 1,000 or higher.

Such a polymer dispersant is a component which easily adheres to the surfaces of the toner particles among the various dispersants described above. Additionally, the polymer dispersant has a function of reliably improving dispersibility of the toner particles in the liquid developer and charge property of the liquid developer.

As described above, the fatty acid monoester is impregnated into the resin material of the toner particles in the liquid developer to thereby plasticize the toner particles reliably. If the polymer dispersant exists on the surfaces of the toner particles, the toner particles are appropriately dispersed in the liquid developer due to a long main chain in a chemical structure of the polymer dispersant. Therefore, it is possible to prevent the toner particles from aggregating and fusing therebetween reliably, and therefore it is possible to improve preservability or storage stability of the liquid developer.

Further, it is preferred that such a polymer dispersant is a condensation of monomers of which each molecule has both one carboxyl group and one hydroxyl group.

Among such a polymer dispersant described above, it is preferred that the polymer dispersant has the chemical structure represented by the following general formula (I), where l is an integer in the range of 9 to 12, m is an integer in the range of 3 to 6, n is an integer in the range of 5 to 8, R represents —OH, R' represents H— or $CH_3(CH_2)_pCO$—, and p is an integer in the range of 15 to 18.

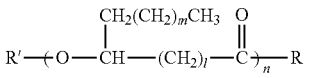

(I)

The polymer dispersant represented by the general formula (I) as described above has ester bonds in its chemical structure and has high affinity to the fatty acid monoester as described above. Therefore, such a polymer dispersant is uniformly dispersed in the insulation liquid containing the fatty acid monoester, so that the polymer dispersant uniformly adheres to the surfaces of the toner particles in the liquid developer.

Such a polymer dispersant has a relatively long main chain and at least one side chain which branches from the long main chain in the chemical structure thereof. Therefore, the polymer dispersant has a great chance in contacting with the surfaces of the toner particles. As a result, the polymer dispersant can adhere to the surfaces of the toner particles firmly.

Adhesion of the polymer dispersant to the surfaces of the toner particles makes it possible to allow the polymer dispersant exist between the toner particles. As a result, it is possible to prevent the toner particles from aggregating therebetween more reliably.

Further, since the toner particles are surrounded by the polymer dispersant having the chemical structure represented by the above general formula (I), it is difficult for the fatty acid monoester to enter into the resin material of the toner particles. Therefore, the resin material is difficult to swell or plasticize. Further, the surfaces of the toner particles to which the polymer dispersant adheres can have appropriate hardness, thereby preventing the toner particles from aggregating therebetween reliably. As a result, it is possible to obtain the liquid developer having superior preservability or storage stability.

Furthermore, since such a polymer dispersant adheres (exists) to the surface of each toner particle uniformly and firmly, it is possible to uniformize charge property of the whole toner particle. This makes it possible to improve development characteristics and transfer characteristics of the liquid developer reliably. As a result, it is possible for the liquid developer to form clear toner images constantly for a long period of time.

According to the present invention, "l", in the above general formula (I) is an integer preferably in the range of 9 to 12, and more preferably 10 or 11. This makes it possible to allow the polymer dispersant to adhere to the surfaces of the toner particles firmly, thereby preventing the toner particles from aggregating more reliably.

Further, it is also possible to improve development characteristics and transfer characteristics of the liquid developer reliably. As a result, it is possible for the liquid developer to form clear toner images constantly for a long period of time.

According to the present invention, "m" in the above general formula (I) is an integer preferably in the range of 3 to 6, and more preferably 4 or 5. This makes it possible to allow the polymer dispersant to adhere to the surfaces of the toner particles firmly, thereby preventing the toner particles from aggregating more reliably.

Further, it is also possible to improve development characteristics and transfer characteristics of the liquid developer reliably. As a result, it is possible for the liquid developer to form clear toner images constantly for a long period of time.

According to the present invention, "n" in the above general formula (I) is an integer preferably in the range of 5 to 8, and more preferably 7 or 8. This makes it possible to entangle the polymer dispersant with the toner particles, thereby preventing the toner particles from aggregating more reliably.

Further, it is also possible to improve development characteristics and transfer characteristics of the liquid developer reliably. As a result, it is possible for the liquid developer to form clear toner images constantly for a long period of time.

According to the present invention, "R'" in the above general formula (I) represents H— or $CH_3(CH_2)_pCO$—, wherein "p" in the $CH_3(CH_2)_pCO$— is an integer preferably in the range of 15 to 18, and more preferably 16 or 17. This makes it possible to allow the polymer dispersant to adhere to the surfaces of the toner particles firmly, thereby preventing the toner particles from aggregating more reliably.

Further, it is also possible to improve development characteristics and transfer characteristics of the liquid developer reliably. As a result, it is possible for the liquid developer to stably form clear toner images for a long period of time.

An amount of such a polymer dispersant contained in the liquid developer is preferably in the range of 1.0 to 10.0 parts by weight with respect to the toner particles of 100 parts by weight, and more preferably in the range of 2.5 to 8.0 parts by weight with respect to the toner particles of 100 parts by weight. This makes it possible to allow the polymer dispersant to adhere to the surfaces of the toner particles uniformly. Therefore, it is possible to prevent the toner particles from aggregating therebetween reliably, thereby exhibiting superior preservability or storage stability of the liquid developer. Further, it is also possible to improve charge property of the whole toner particle.

Further, the insulation liquid may further contain an antioxidant therein. Furthermore, the liquid developer (insulation liquid) may further contain a charge control agent therein.

Examples of such a charge control agent include: metal oxides such as zinc oxide, aluminum oxide, and magnesium oxide; metal benzoates, metal salicylates, metal alkyl alicylates, catechol metal salts, bis azo dyes containing metal, nigrosin dyes, tetraphenyl borate derivatives, quaternary ammonium salts, alkylpyridinium salts, chlorinated polyesters, nitro phnic acid and the like.

The electric resistance of the insulation liquid at room temperature (20° C.) described above is preferably equal to or higher than $1.0\times10^{11}$ Ωcm, more preferably equal to or higher than $1.0\times10^{12}$ Ωcm, and even more preferably equal to or higher than $2.0\times10^{12}$ Ωcm. Further, the dielectric constant of the insulation liquid is preferably equal to or lower than 3.5.

Furthermore, at least a part of the fatty acid monoester enters into the resin material of the toner particles in the liquid developer. In this case, a glass transition temperature Tg of the resin material is measured by a differential scanning calorimetry (DSC). It is preferred that the glass transition temperature Tg of the resin material is lower than a glass transition temperature of a resin material of the tonner particles in a state that no fatty acid monoester has been impregnated into the resin material. The difference between the glass transition temperatures is preferably in the range of 10 to 30° C., more preferably in the range of 15 to 28° C. lower, and even more preferably in the range of 20 to 25° C. lower.

This makes it possible for the fatty acid monoester to enter into the resin material of the toner particles, thereby plasticizing the resin material. Even if the plasticized toner particles are in contact with each other, it is possible to prevent aggregation and fusion of the toner particles reliably. As a result, it becomes possible to reliably improve preservability or storage stability of the liquid developer. It is also possible to fix the toner particles onto a recording medium at a low temperature reliably.

Further, if the liquid developer of the invention meets each of the parameters as described above, the glass transition temperature Tg of the resin material contained in the toner particles falls within the above noted range more reliably.

In this regard, it is to be noted that a viscosity (measured according to JIS Z8809 using a vibration type viscometer at a temperature of 25° C.) of the liquid developer (the liquid developer of the present invention) constituted of each component as described above is in the range of 20 to 900 mPa·s, more preferably in the range of 30 to 800 mPa·s, and even more preferably 50 to 500 mPa·s.

The liquid developer having the viscosity within the above range is easily impregnated into a recording medium. Therefore, fixing characteristics of the toner particles to a recording medium becomes excellent, and a clear and even color image can be formed on the recording medium, and thus such a liquid developer can be suitably used for high speed image formation.

Further, the electric resistance of the liquid developer constituted of the components as described above, that is, the electric resistance of the liquid developer of the present invention is preferably $1.0\times10^{11}$ Ωcm or higher, and more preferably $1.0\times10^{12}$ Ωcm or higher at room temperature (20° C.).

Method of Producing Liquid Developer

Hereinbelow, a preferred embodiment of a method of producing a liquid developer of the present invention will be described. In this regard, it is to be noted that the following description of the embodiment will be made based on the case that an insulation liquid contains a fatty acid monoester and other components.

The method of producing the liquid developer in this embodiment includes: an associated particle formation step of associating resin fine particles constituted of a resin material to obtain associated particles; a disassociating step of disassociating the associated particles in a fatty acid monoester to obtain a toner particle dispersion liquid in which toner particles are dispersed in the fatty acid monoester; and a mixing step of mixing the thus obtained toner particle dispersion liquid and the other components constituting an insulation liquid.

Production of Associated Particles

Hereinbelow, a description will be made with regard to one example of a method of producing the associated particles which are formed by associating the resin fine particles mainly constituted from the resin material.

The associated particles may be formed by various methods. In this embodiment, a water-based dispersion liquid comprised of a water-based dispersion medium constituted of a water-based liquid and a dispersoid (fine particles) constituted of the resin material (toner material) dispersed in the water-based dispersion medium is first obtained, and then the dispersoid in the water-based dispersion medium is associated to thereby obtain the associated particles.

Preparation of Water-Based Dispersion Liquid

Hereinbelow, a description will be made with regard to preparation of the water-based dispersion liquid.

The water-based dispersion liquid may be prepared by various methods. In this embodiment, the toner material as described above is first dissolved in a solvent to thereby obtain a toner material solution, the toner material solution is then mixed with a water-based dispersion medium constituted of a water-based liquid to thereby obtain a water-based emulsion in which the dispersoid (liquid state dispersoid) containing the toner material is dispersed, and then at least a part of the solvent contained in the water-based emulsion is removed to thereby obtain the water-based dispersion liquid.

For example, the water-based emulsion may be prepared as follows (Water-based Emulsion Preparation Step).

First, a water-based dispersion medium is prepared. In the present invention, the water-based dispersion medium is constituted of a water-based liquid. In the present invention, the term "water-based liquid" means a liquid constituted of water and/or a liquid having good compatibility with water (for example, a liquid having a solubility of 30 g or higher with respect to water of 100 g at 25° C.).

As described above, the water-based liquid is constituted of water and/or a liquid having good compatibility with water, but it is preferred that the water-based liquid is mainly constituted of water. Preferably, the water content is 70 wt % or more, and more preferably 90 wt % or more.

By using such a water-based liquid, it is possible to increase the dispersion stability of the dispersoid in the water-based dispersion medium and thus it is also possible to make the dispersoid in the water-based emulsion have small particle size and small particle size variation. As a result, the toner particles in the finally obtained insulation liquid can have small particle size variation and large roundness.

Examples of such the water-based liquid include: water; an alcohol-based solvent such as methanol, ethanol, and propanol; an ether-based solvent such as 1,4-dioxane, and tetrahydrofuran (THF); an aromatic heterocyclic compound-based solvent such as pyridine, pyrazine, and pyrrole; an amide-based solvent such as N,N-dimethylformamide (DMF), and N,N-dimethylacetamide (DMA); a nitrile-based solvent such as acetonitrile; and an aldehyde-based solvent such as acetaldehyde; and the like.

Further, in preparing the water-based emulsion, an emulsion dispersant or the like may be used for the purpose of improving the dispersion stability of the water-based dispersion medium. This makes it possible to prepare the water-based emulsion more easily. Examples of such emulsion dispersant include, but not limited thereto, a known emulsion dispersant and the like.

The toner material solution is prepared by dissolving the toner material as described above into a solvent. Various solvents may be employed if they can dissolve a part of the toner material, but it is preferable to use a solvent having a boiling point lower than that of the water-based liquid. This makes it possible to remove the solvent easily.

Further, it is also preferred that the solvent has low compatibility with the water-based dispersion medium (water-based liquid) (for example, a liquid having solubility of 30 g or lower with respect to a water-based liquid of 100 g at 25° C.). This makes it possible for the toner material to be finely dispersed in the water-based emulsion in a stable manner.

Further, a composition of the solvent can be selected appropriately according to the compositions of the resin and the coloring agent to be used, and the compositions of the water-based dispersion medium to be used or the like.

Examples of such a solvent include, but not limited thereto, a ketone solvent such as methyl ethyl ketone (MEK), an aromatic hydrocarbon solvent such as toluene, and the like.

In preparing the toner material solution, a kneaded material obtained by kneading the toner material such as the resin material, the coloring agent and the like may be used.

By using such a kneaded material as described above, even in the case where the constituent material of the liquid developer contains components which are difficult to be dispersed or dissolved to each other, it is possible to obtain a state that the components are mutually dissolved and finely dispersed in a satisfactory level in the kneaded material obtained by the kneading process.

In particular, in the case where a pigment (coloring agent) having relatively low dispersion stability to a solvent as described above is used, a periphery of each particle of the pigment is effectively coated with the resin component of the kneaded material during the kneading process carried out before the dispersion to the solvent.

This makes it possible to improve dispersion stability of the pigment to the solvent (particularly, it becomes possible to finely disperse the particles of the pigment in the solvent). As a result, the finally obtained liquid developer can exhibit excellent color development.

Accordingly, even in the case where the constituent material of the toner particles contains a component having poor dispersion stability to the water-based dispersion medium of the water-based emulsion and/or a component having poor solubility to the solvent contained in the water-based dispersion medium of the water-based emulsion, it is possible to make the dispersion stability of the dispersoid contained in the water-based emulsion especially excellent.

Next, the toner material solution is added drop by drop to the water-based dispersion medium with being stirred. As a result, it is possible to obtain the water-based emulsion comprised of the water-based dispersion medium and the dispersoid containing the toner material which is dispersed in the water-based dispersion medium. In this regard, it is to be noted that when the toner material solution is added drop by drop, the water-based dispersion medium and/or the toner material solution may be heated.

Further, the water-based dispersion medium may be added drop by drop to the toner material solution with being stirred instead of the above method. Addition of the water-based dispersion medium into the toner material solution makes it possible for the toner material solution to cause phase inversion emulsification. Therefore, it is possible to obtain the water-based emulsion in which the dispersoid containing the toner particles is dispersed in the water-based dispersion medium like the water-based emulsion obtained by the above method.

Thereafter, by heating the thus obtained water-based emulsion or placing it under reduced pressure, at least a part of the solvent contained in the water-based emulsion is removed. As a result, it is possible to obtain the water-based dispersion liquid in which the dispersoid (fine particles) constituted of the toner material is dispersed.

An amount of the dispersoid in the water-based dispersion liquid is not particularly limited, but preferably in the range of 5 to 55 wt %, and more preferably in the range of 10 to 50 wt %. This makes it possible to prevent bonding or aggregation of particles of the dispersoid in the water-based dispersion liquid more reliably, thereby enabling productivity of the toner particles (liquid developer) to be particularly excellent.

An average diameter of the particles of the dispersoid in the water-based dispersion liquid is not particularly limited, but preferably in the range of 0.01 to 3 μm, and more preferably in the range of 0.1 to 2 μm. This makes it possible to make the size of the toner particles finally obtained optimum. In this regard, it is to be noted that the term "average diameter" means an average diameter of particles each having a reference volume.

Associated Particle Formation Step

Next, an electrolyte is added to the water-based dispersion liquid obtained by the processes as described above so that the fine particles of the dispersoid are associated to thereby form associated particles.

Examples of an electrolyte to be added include: an acidic substance such as hydrochloric acid, sulfuric acid, phosphoric acid, acetic acid, and oxalic acid; an organic or inorganic soluble salt such as sodium sulfate, ammonium sulfate, potassium sulfate, magnesium sulfate, sodium phosphate, sodium dihydrogen phosphate, sodium chloride, potassium chloride, ammonium chloride, calcium chloride, and sodium acetate; and the like. These electrolytes can be used singly or in combination of two or more.

Among these electrolytes as mentioned above, sulfate salts of monovalent cation such as potassium sulfate, ammonium sulfate and the like are preferably used because association of the fine particles is carried out uniformly.

Further, before the electrolyte is added to the water-based dispersion liquid, an inorganic dispersion stabilizer such as hydroxyapatite ionic surfactant, nonionic surfactant and the like may be added to the water-based dispersion liquid. By adding the electrolyte to the water-based dispersion liquid under the existence of the dispersion stabilizer (emulsifier), it is possible to prevent ununiform association.

Examples of such a dispersion stabilizer include: a nonionic surfactant such as polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, various pluronic types and the like; an anionic surfactant such as alkyl sulfate ester salt types; a cationic surfactant such as quaternary ammonium salt types; and the like.

Among these dispersion stabilizers as mentioned above, the anionic surfactant and the nonionic surfactant are preferably used because of being capable of exhibiting the excellent dispersion stability with the addition of a small amount thereof. A cloud point of the nonionic surfactant is preferably equal to or higher than 40° C.

An amount of the electrolyte to be added is preferably in the range of 0.5 to 15 parts by weight, more preferably in the range of 1 to 12 parts by weight, and even more preferably in the range of 1 to 10 parts by weight with respect to 100 parts by weight of solid components of the water-based dispersion liquid.

If the amount of the electrolyte is lower than the lower limit value, there is a case that association of the dispersoid does not progress sufficiently.

Further, if the amount of the electrolyte exceeds the higher limit value, association of the dispersoid becomes ununiform. As a result, there is a possibility that coarsened particles are produced in the water-based dispersion liquid, and thereby the size of toner particles finally obtained becomes uneven.

Next, after associating the fine particles of the dispersoid, associated particles are obtained by filtering, washing, and drying them. An average particle size of the obtained associated particles is preferably in the range of 0.1 to 7 μm, and more preferably in the range of 0.5 to 3 μm. This enables toner particles finally obtained to have an appropriate particle size.

Disassociating Step (Step of Obtaining Toner Particle Dispersion Liquid)

Next, the associated particles are disassociated in a fatty acid monoester to thereby obtain a toner particle dispersion liquid comprised of the toner particles dispersed in the fatty acid monoester.

As described above, the fatty acid monoester is a component which has high affinity to the resin material constituting the toner particles. Therefore, when the associated particles are disassociated in the fatty acid monoester, the fatty acid monoester can easily enter between fine particles (dispersoid) constituting the associated particles so that it is possible to disassociate the associated particles with a smaller energy efficiently.

Further, the fatty acid monoester can also easily enter into the toner particles obtained by disassociating the associated particles so that it is possible to plasticize the toner particles in the liquid developer reliably. As a result, it is possible for the obtained liquid developer to exhibit both superior preservability or storage stability and superior fixing characteristics at a low temperature.

Further, since the associated particles are disassociated in the fatty acid monoester, it is possible to prevent production of toner particles coarsened by the aggregation and the like. Further, since the obtained toner particles have gaps derived from the fine particles (dispersoid) on the surfaces thereof, the fatty acid monoester is retained in the gaps reliably.

Further, in this embodiment, since the toner particles are obtained by disassociating the associated particles, it is possible to prevent generation of fine powder (extremely fine particles which are smaller than the particles having a target particle size.) as compared to the case where the conventional disassociating method or wet crushing method is used. As a result, it is possible to effectively prevent deterioration of the charge property of the liquid developer due to the presence of the fine powder.

Furthermore, since the fatty acid monoester has the relatively lower viscosity, the fatty acid monoester can easily enter into spaces among the fine particles constituting each of the associated particles, and thus it is possible to disassociate the associated particles relatively easily.

Mixing Step

Next, the thus obtained toner particle dispersion liquid is mixed with the other components constituting an insulation liquid, so that the toner particles are dispersed in the insulation liquid (mixing step). Through the processes as described above, it is possible to obtain the liquid developer of the present invention which is comprised of the insulation liquid containing the fatty acid monoester and the toner particles dispersed in the insulation liquid.

In the description of the method of producing the liquid developer of the present invention, the method in this embodiment includes the disassociating step of disassociating the obtained associated particles in the fatty acid monoester. However, in the present invention, a liquid developer may be produced by directly dispersing the obtained associated particles into the components constituting the insulation liquid without the disassociating step described above.

First Embodiment of Image Forming Apparatus

Next, a description will be made with regard to a first embodiment of an image forming apparatus of the present invention. The image forming apparatus of the present invention is an apparatus which forms color images on a recording medium by using a liquid developer of the present invention as described above.

Figure 2:
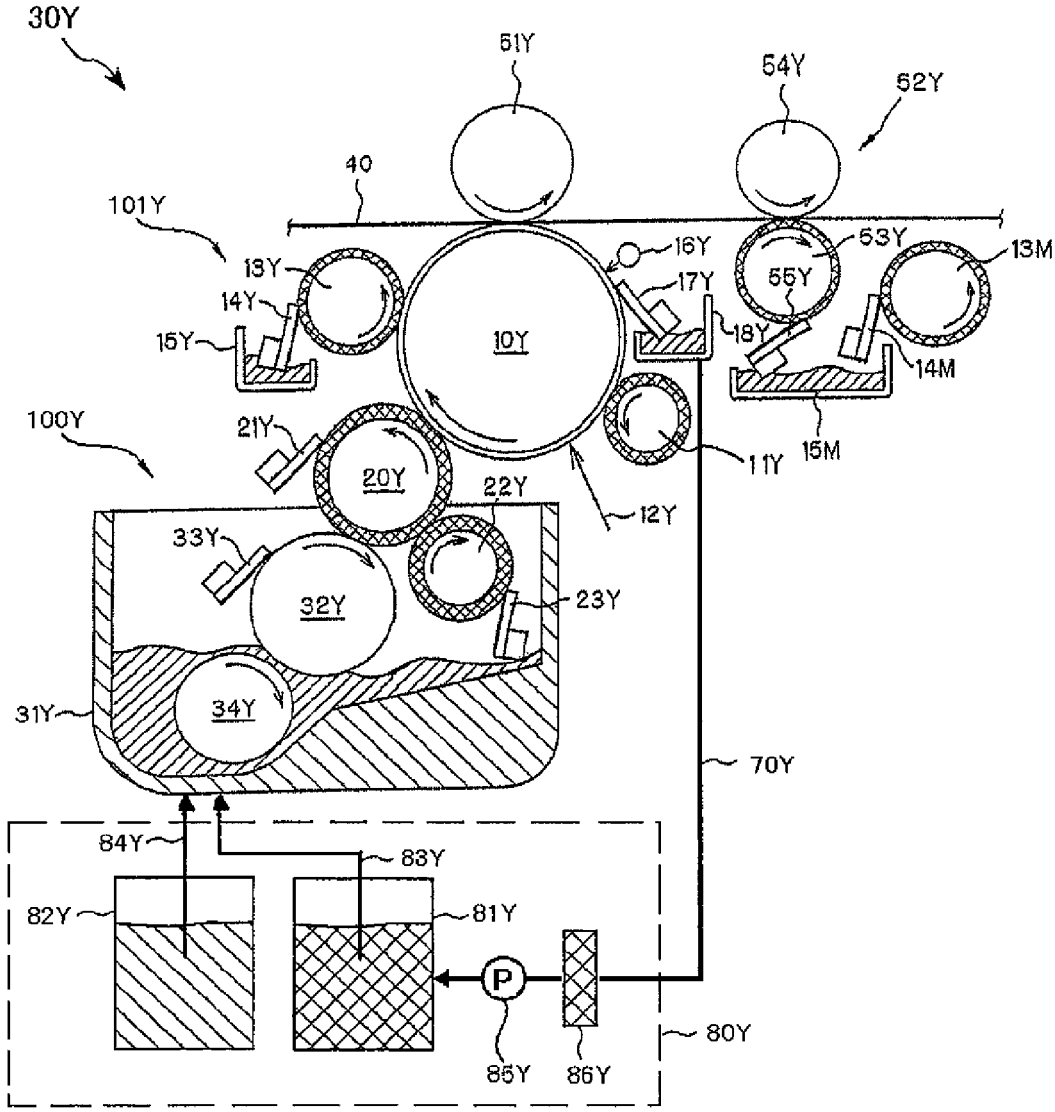
FIG. 2 is an enlarged view of a part of the image forming apparatus shown in FIG. 1.
Figure 3:
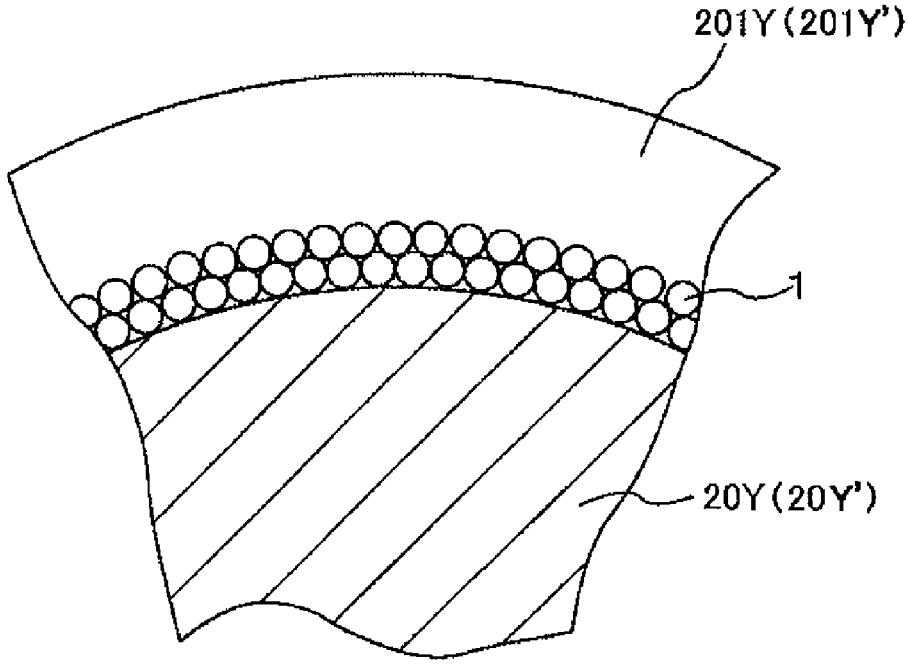
FIG. 3 is a schematic view which shows a state of toner particles in a layer of a liquid developer on a developing roller.
Figure 4:
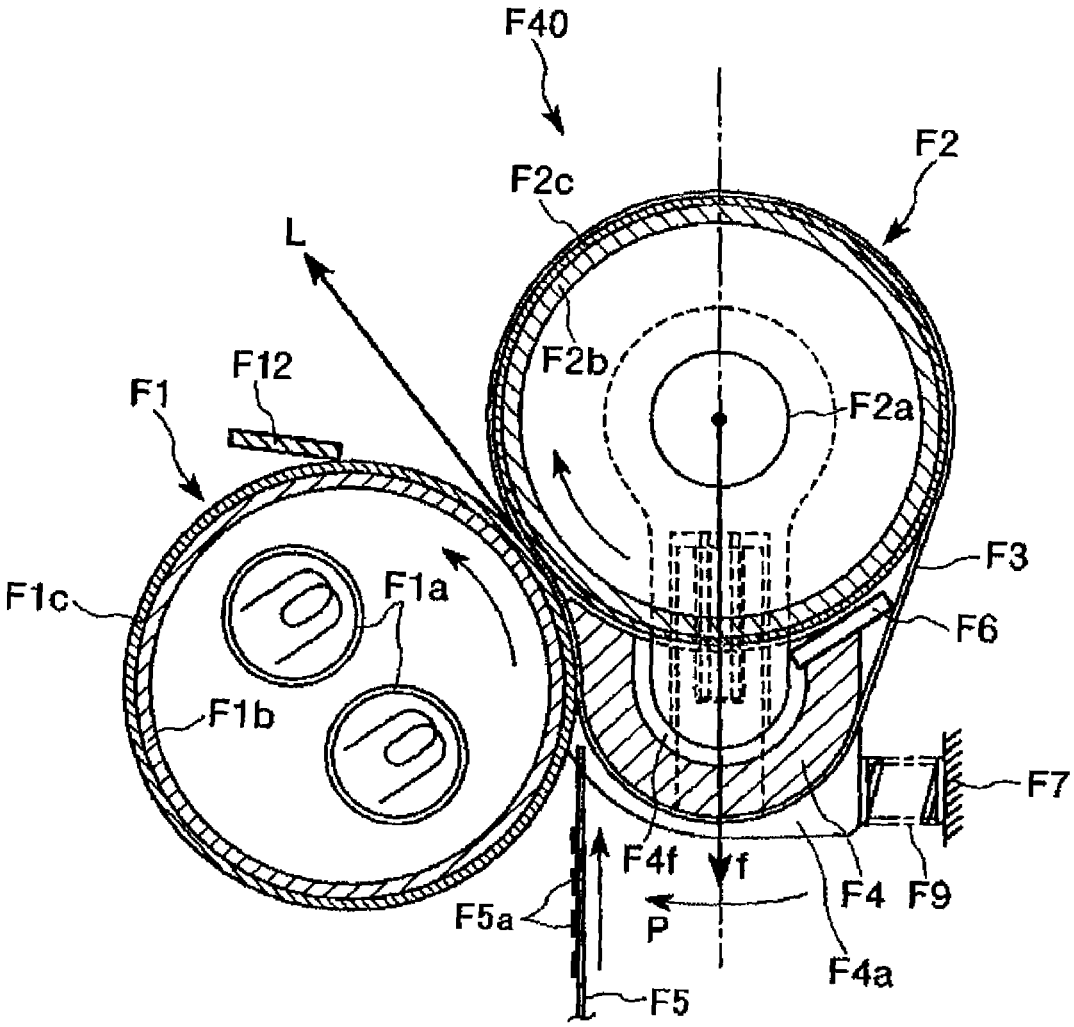
FIG. 4 is a cross-sectional view which shows one example of a fixing unit provided in the image forming apparatus shown in FIG. 1.

FIG. 1 is a schematic view which shows a first embodiment of an image forming apparatus to which the liquid developer of the present invention can be used. FIG. 2 is an enlarged view of a part of the image forming apparatus shown in FIG. 1. FIG. 3 is a schematic view which shows a state of toner particles in a layer of the liquid developer on the development roller. FIG. 4 is a cross-sectional view which shows one example of a fixing unit provided in the image forming apparatus shown in FIG. 1.

As shown in FIG. 1 and FIG. 2, the image forming apparatus 1000 includes four developing sections comprised of 30Y, 30C, 30M and 30K, an intermediate transfer section 40, a secondary transfer unit (secondary transfer section) 60, a fixing section (fixing unit) F40 and four liquid developer supply sections 80Y, 80M, 80C and 80K.

The developing sections 30Y, 30C and 30M contain respectively a yellow (Y) liquid developer, a cyan (C) liquid developer, and a magenta (M) liquid developer, and have the functions of developing latent images with the liquid developers to form monochromatic color images corresponding to the respective colors. Further, the developing section 30K contains a black (K) liquid developer, and has the function of developing a latent image with the liquid developer to form a black monochromatic image.

The developing sections 30Y, 30C, 30M and 30K have the same structure. Therefore, in the following, the developing section 30Y will be representatively described.

As shown in FIG. 2, the developing section 30Y includes a photoreceptor 10Y which carries a latent image and rotates in the direction of the arrow shown in the drawings. The image forming apparatus 1000 further includes an electrifying roller 11Y, an exposure unit 12Y, a developing unit 100Y, a photoreceptor squeeze device 101Y, a primary transfer backup roller 51Y, an electricity removal unit 16Y, a photoreceptor cleaning blade 17Y, and a developer collecting section 18Y, and they are arranged in the named order along the rotational direction of the photoreceptor 10Y.

The photoreceptor 10Y includes a cylindrical conductive base member and a photosensitive layer (both not shown in the drawings) formed on the outer peripheral surface of the base member, and is rotatable about the axis thereof in the clockwise direction as shown by the arrow in FIG. 1.

The liquid developer from the developing unit 100Y is supplied onto the surface of the photoreceptor 10Y so that a layer of the liquid developer is formed on the surface.

The electrifying roller 11Y is a device for uniformly electrifying the surface of the photoreceptor 10Y. The exposure unit 12Y is a device that forms an electrostatic latent image on the uniformly photoreceptor 10Y by means of laser beam irradiation.

The exposure unit 12Y includes a semiconductor laser, a polygon mirror, or an F-θ lens, or the like, and irradiates a modulated laser beam onto the electrified photoreceptor 10Y in accordance with image signals received from a host computer such as a personal computer, a word processor or the like not shown in the drawings.

The developing unit 100Y is a device which develops the latent image to be visible with the liquid developer of the invention. The details of the developing unit 100Y will be described later.

The photoreceptor squeeze device 101Y is disposed so as to face the photoreceptor 11Y at the downstream side of the developing unit 100Y in the rotational direction thereof. The photoreceptor squeeze device 101Y is composed from a photoreceptor squeeze roller 13Y, a cleaning blade 14Y which is press contact with the photoreceptor squeeze roller 13Y for removing a liquid developer adhering to the surface of the photoreceptor squeeze roller 13Y, and a developer collecting section 15Y for collecting the removed liquid developer.

The photoreceptor squeeze device 101Y has a function of collecting of an excess carrier (insulation liquid) and a fog toner which is inherently unnecessary from the liquid developer developed by the photoreceptor 10Y to increase a ratio of the toner particles in the image to be formed.

The primary transfer backup roller 51Y is a device for transferring a monochrome toner image formed on the photoreceptor 10Y to the intermediate transfer section (belt) 40.

The electricity removal unit 16Y is a device for removing a remnant charge on the photoreceptor 10Y after an intermediate image has been transferred to the intermediate transfer section 40 by the primary transfer backup roller 51Y.

The photoreceptor cleaning blade 17Y is a member made of rubber and provided in contact with the surface of the photoreceptor 10Y, and has a function of scrapping off the liquid developer remaining on the photoreceptor 10Y after the image has been transferred onto the intermediate transfer section 40 by the primary transfer backup roller 51Y.

The developer collecting section 18Y is provided for collecting the liquid developer removed by the photoreceptor cleaning blade 17Y. The intermediate transfer section 40 is composed from an endless elastic belt which is wound around a belt drive roller 41 and a tension roller 42, and the endless belt is rotationally driven by the belt drive roller 41 in contact with the photoreceptors 10Y, 10M, 10C and 10K at respective positions of the primary transfer backup rollers 51Y, 51C, 51M and 51.

Monochromatic images corresponding to the respective colors formed by the developing sections 30Y, 30C, 30M and 30K are sequentially transferred by the primary transfer backup roller 51Y, 51C, 51M and 51K so that the monochromatic images corresponding to the respective colors are overlaid, thereby enabling a full color toner image (intermediate transferred image) to be formed on the intermediate transfer section 40 which will be described later.

The intermediate transfer section 40 carries the monochromatic images formed on the respective photoreceptors 10Y, 10M, 10C and 10K in a state that these images are successively secondary-transferred onto the belt so as to be overlaid one after another, and the overlaid images are transferred onto a recoding medium F5 such as paper, film and cloth as a single color image.

In the meantime, when the toner image is transferred onto the recording medium F5 in the secondary transfer process, there is a case that the recording medium F5 is not a flat sheet material due to fibers thereof. The elastic belt is employed as a means for increasing secondary transfer characteristics for such a non-flat sheet material.

At the side of the tension roller 42 which constitutes the intermediate transfer section 40 together with the belt drive roller 41, a cleaning device composed from an intermediate transfer section cleaning blade 46 and a developer collecting section 47.

The intermediate transfer section cleaning blade 46 has a function of scrapping off of the liquid developer adhering to the intermediate transfer section 40 to remove it after the image has been transferred onto a recording medium by the secondary transfer roller 61.

The developer collecting section 47 is provided for collecting the liquid developer removed by the intermediate transfer section cleaning blade 46. An intermediate transfer second squeeze device 52Y is provided at the downstream side of the primary transfer backup roller 51Y in the moving direction of the intermediate transfer section 40.

The intermediate transfer squeeze device 52Y is provided as a means for removing an excess amount of the insulation liquid from the transferred liquid developer in the case where the liquid developer transferred onto the intermediate transfer section 40 does not have a desired dispersion state.

The intermediate transfer squeeze device 52Y includes an intermediate transfer squeeze roller 53Y, an intermediate transfer squeeze backup roller 54Y which is arranged so as to be opposed to the intermediate transfer squeeze roller 53Y through the intermediate transfer section 40, an intermediate transfer squeeze roller cleaning blade 55Y which is in press contact with the intermediate transfer squeeze roller 53Y for cleaning the surface thereof, and a liquid developer collecting section 15M.

The intermediate transfer squeeze device 52Y has a function of collecting an excess carrier from the liquid developer primary-transferred to the intermediate transfer section 40 to increase a ratio of the toner particles in an image to be formed and collecting a fog toner which is inherently unnecessary.

The developer collecting section 15M is also used for collecting a carrier which is collected by a cleaning blade 14M for a magenta photoreceptor squeeze roller which is arranged at the downstream side of the intermediate transfer section 40 in the moving direction thereof.

By commonly using each of the developer collecting sections 15 (M, C, K) as each of the developer collecting sections for the intermediate transfer section squeeze devices 52 (Y, M, C), respectively, it is possible to set the interval between the adjacent developer collecting sections in the same distance, thereby enabling the structure of the image forming apparatus to be simplified and small-sized.

In the secondary transfer unit 60, the secondary transfer roller 61 is arranged so as to be opposed to the belt drive roller 41 through the intermediate transfer section 40. Further, the secondary transfer unit 60 includes a cleaning device composed from a cleaning blade 62 for the secondary transfer roller 61 and a developer collecting section 63.

In the secondary transfer unit 60, at a timing that an intermediate image formed on the intermediate transfer section 40 by overlaying difference color images reaches at the image transfer position of the secondary transfer unit 60, a recording medium F5 is conveyed and supplied, so that the intermediate image is secondary-transferred onto the recording medium F5.

A toner image (transferred image) F5*a* transferred onto the recording medium F5 by the secondary transfer section 60 is fed to a fixing unit (fixing device) F40 (which will be described later), where the unfixed toner image is fixed onto the recoding medium F5.

The cleaning blade 62 has a function of scrapping off the liquid developer adhering to the second transfer roller 61 to remove it after the image has been transferred onto the recording medium F5 by the second transfer roller 61. The developer collecting section 63 is provided for collecting the liquid developer removed by the cleaning blade 62.

Hereinbelow, a detailed description will be made with regard to the developing units 100Y, 100C, 100M and 100K. In this regard, it is to be noted that since the developing units 100Y, 100C, 100M and 100K have the same structure, in the following description the developing section 100Y will be representatively described.

As shown in FIG. 2, the developing unit 100Y includes a liquid developer storage section 31Y, an application roller 32Y, a regulating blade 33Y, a liquid developer stirring roller 34Y, a developing roller 20Y, a developing roller cleaning blade 21Y and a developer pressing roller (pressing means) 22Y.

The liquid developer storage section 31Y is provided for storing a liquid developer for developing a latent image formed on the photoreceptor 10Y. The application roller 32Y has the function of supplying the liquid developer to the developing roller 20Y. The application roller 32Y is of the type so-called as "Anilox Roller" which is constructed from a metallic roll made of iron or the like of which surface has grooves formed regularly and helically, and a nickel plating formed on the surface.

The diameter of the roller is about 25 mm. In this embodiment, a number of grooves are formed inclinedly with respect to the rotational direction by means of a cutting process or rolling process. The application roller 32Y rotates in a clockwise direction and makes contact with the liquid developer so that the liquid developer stored in the liquid developer storage section 31Y is carried by the grooves, and the carried liquid developer is then conveyed to the developing roller 20Y.

The regulating blade 33Y is provided in contact with the surface of the application roller 32Y for regulating an amount of the liquid developer carried on the application roller 32Y. Specifically, the regulating blade 33Y scrapes away an excess amount of the liquid developer on the application roller 32Y so that an amount of the liquid developer to be supplied onto the developing roller 20Y by the application roller 32Y can be regulated.

The regulating blade 33Y is formed from an elastic body made of an urethane rubber, and supported by a regulating blade supporting member made of a metal such as iron or the like. Further, the regulating blade 33Y is arranged on the side where the application roller 32Y comes out of the liquid developer with its rotation (that is, on the left side of the application roller 32Y in FIG. 2).

In this regard, it is to be noted that the rubber hardness of the regulating blade 33Y, that is, a rubber hardness (77) of a portion of the regulating blade 33Y which in press contact with the surface of the application roller 32Y is about 77 according to JIS-A.

The rubber hardness (77) of the regulating blade 33Y is lower than the rubber hardness of an elastic layer of the developing roller 20Y (described later) which is a rubber hardness (about 85) of a portion of the developing roller 20Y which is in press contact with the surface of the application roller 32Y.

Further, the excess amount of the liquid developer scraped off by the regulating blade 33Y is collected in the liquid developer storage section 31Y and it is then reused.

The liquid developer stirring roller 34Y has a function of stirring the liquid developer so as to be homogeneously dispersed. By providing such a liquid developer stirring roller 34Y, even when a plurality of toner particles 1 are aggregated in the liquid developer storage section 31Y, it is possible to disperse the toner particles 1 preferably. Especially, even when the liquid developer used once is reused, it is possible to disperse the toner particles 1 preferably.

In the liquid developer storage section 31Y, the plurality of toner particles of the liquid developer are positively charged. The liquid developer is stirred by the liquid developer stirring roller 34Y to be a homogeneously dispersed state, and such a liquid developer is dipped from the liquid developer storage section 31Y according to the rotation of the application roller 32Y so that the liquid developer is supplied onto the developing roller 20Y with the amount of the liquid developer being regulated by the regulating blade 33Y.

The developing roller 20Y is provided for conveying the liquid developer to a developing position opposed to the photoreceptor 10Y in order to develop a latent image carried on the photoreceptor 10Y with the liquid developer. The liquid developer from the application roller 32Y is supplied onto the surface of the developing roller 20Y so that a layer of the liquid developer 201Y is formed on the surface (FIG. 3).

The developing roller 20Y includes an inner core member made of a metal such as iron or the like and an elastic layer having conductivity and provided onto an outer periphery of the inner core member. The diameter of the developing roller 20Y is about 20 mm.

The elastic layer has a two layered structure which includes an inner layer made of urethane rubber and an outer layer (surface layer) made of urethane rubber. The inner layer has a rubber hardness of 30 according to JIS-A and a thickness of about 5 mm, and the outer layer has a rubber hardness of about 85 according to JIS-A and a thickness of about 30 μm.

The developing roller 20Y is in press contact with both the application roller 32Y and the photoreceptor 10Y in a state that the outer layer of the developing roller 20Y is elastically deformed.

The developing roller 20Y is rotatable about its central axis, and the central axis is positioned below the central axis of the photoreceptor 10Y. Further, the developing roller 20Y rotates in a direction (clockwise direction in FIG. 2) opposite to the rotational direction (anti-clockwise direction in FIG. 2) of the photoreceptor 10Y.

It is to be noted that an electrical field is generated between the developing roller 20Y and the photoreceptor 10Y when a latent image formed on the photoreceptor 10Y is developed.

The developer pressing roller 22Y is a device having a function of pressing toner particles of the liquid developer carried by the developing roller 20Y. In other words, the developer pressing roller 22Y is a device that applies an electrical field of the same polarity as a toner particle 1 to the liquid developer layer 201Y described above to thereby unevenly distribute the toner particles 1 at the vicinity of the developing roller 20Y in the liquid developer layer 201Y as shown in FIG. 3.

By unevenly distributing the toner particles in this way, it is possible to improve an image density (developing efficiency), and as a result it becomes possible to obtain a high quality clear image.

A cleaning blade 23Y is provided in contact with the surface of the developer pressing roller 22Y. The cleaning blade 23Y has a function of removing the liquid developer adhering to the surface of the developer pressing roller 22Y. The liquid developer removed by the cleaning blade 23Y is collected in the liquid developer storage section 31Y and it is then reused.

The developing unit 100Y has the developing roller cleaning blade 21Y made of rubber and provided in contact with the surface of the developing roller 20Y. The developing roller cleaning blade 21Y is a device for scrapping off the liquid developer remaining on the developing roller 20Y after the development of an image has been carried out at the developing position. The liquid developer removed by the developing roller cleaning blade 21Y is collected and reused in the liquid developer storage section 31Y.

As shown in FIG. 1 and FIG. 2, the image forming apparatus 1000 is provided with liquid developer supply sections 80Y, 80M, 80C and 80K which supply the liquid developers to the developing sections 30Y, 30M, 30C and 30K, respectively.

The liquid developer supply sections 80Y, 80M, 80C and 80K have the same structure, respectively. Namely, the liquid developer supply sections 80Y, 80M, 80C and 80K are provided with collected liquid developer storage sections 81Y, 81M, 81C and 81K, supply liquid developer storage sections 82Y, 82M, 82C and 82K, feeding means 83Y, 84Y, 83M, 84M, 83C, 84C, 83K and 84K, pumps 85Y, 85M, 85C and 85K and filters 86Y, 86M, 86C and 86K, respectively.

Hereinbelow, a detailed description will be made with regard to the liquid developer supply sections 80Y, 80M, 80C and 80K. In this regard, it is to be noted that since the liquid developer supply sections 80Y, 80M, 80C and 80K have the same structure as described above, in the following description the liquid developer supply section 80Y will be representatively described.

The collected liquid developer storage section 81Y stores the liquid developer collected in the developer collecting section 18Y. The corrected liquid developer is supplied to the liquid developer storage section 31Y of the developing section 30Y by the feeding means 83Y.

The liquid developer is stored in the supply liquid developer storage section 82Y, and the stored liquid developer is supplied to the liquid developer storage section 31Y by the feeding means 84Y.

In this regard, it is to be noted that compositions of the liquid developer which is stored in the supply liquid developer storage section 82Y and the collected liquid developer which is stored in the collected liquid developer storage section 81Y may be the same composition as that of the liquid developer which is stored in the liquid developer storage section 31Y, or may be different from that of the liquid developer which is stored in the liquid developer storage section 31Y.

Further, the liquid developer collected in the developer collecting section 18Y is supplied to the supply liquid developer storage section 81Y of the liquid developer supply section 80Y by a feed line 70Y.

In the feed line 70Y, a pump 85Y is provided. And by using the pump 85Y, the liquid developer collected in the developer collecting section 18Y is fed to the supply liquid developer storage section 81Y of the liquid developer supply section 80Y. Further, in the feed line 70Y, a filter 86Y is provided between the developer collecting section 18Y and the pump 85Y to remove coarsened particles, foreign substances and the like from the collected liquid developer.

Further, the solid matter such as the coarsened particles and foreign substances removed by the filter 86Y is detected by a detecting means for detecting a state of the filter means (not shown in the drawing). Base on the detected result, the filter 86Y can be replaced. This makes it possible to maintain the filtering function of the filter 86Y stably.

Next, a description will be made with regard to a fixing section F40.

The fixing unit (fixing section) F40 is provided for fixing unfixed toner images F5*a* formed on the developing section and the transfer section onto a recording medium F5. As shown in the FIG. 4, the fixing unit (fixing section) F40 is generally composed from a heat fixing roller F1, a pressure roller F2, a heat resistant belt F3, a belt tension member F4, a cleaning member F6, a frame F7 and a spring F9.

The heat fixing roller (hereinafter, simply referred to as "fixing roller") F1 has a roller base F1*b* formed from a pipe member, an elastic body F1*c* which covers the outer periphery of the roller base F1*b*, and a pair of halogen lamps F1*a* provided inside the roller base F1. Each of the halogen lamps F1*a* has a columnar shape and acts as a heat source. The heat fixing roller F1 having the above structure is rotatable in an anti-clockwise direction shown by the arrow in the drawing.

Further, as described above, inside the heat fixing roller F1, two halogen lamps F1*a*, F1*a* each having a columnar shape and acting as a heat source are provided. These halogen lamps F1*a*, F1*a* are provided with heating elements, respectively, which are arranged at different positions.

With this arrangement, by selectively lighting up any one or both of the halogen lamps F1*a*, F1*a*, it is possible to easily carry out a temperature control under different conditions such as a case where a wide recording medium is used or a narrow recording medium is used, and/or a case where a fixing nip part at which the heat resistant belt F3 is wound around the heat fixing roller F1 is to be heated or a part at which the belt tension member F4 is in slidably contact with the heat fixing roller F1 is to be heated.

The pressure roller F2 is arranged so as to face the heat fixing roller F1 so that a pressing pressure is applied against the recording medium F5 on which an unfixed toner image F5*a* is formed through a heat resistant belt F3.

Further, as described above, the pressure roller F2 has a roller base F2*b* formed from a pipe member and an elastic body F2*c* which covers the outer periphery of the roller base F2*b*. The pressure roller F2 is rotatable in a clockwise direction shown by the arrow in the drawing.

On the outer surface of the elastic body F1*c* of the heat fixing roller F1, there is formed a PFA layer. By composing the heat fixing roller F1 and the pressure roller F2 as mentioned above, even if the thickness of the elastic body F1*c* of the heat fixing roller F1 is different from the thickness of the elastic body F2*c* of the pressure roller F2, the elastic body F1*c* and the elastic body F2*c* are subjected to substantially uniform elastic deformation to form a so-called horizontal nip.

Further, since there is no difference between a circumferential velocity of the heat fixing roller F1 and a conveying speed of a heat resistant belt F3 described below or a recording medium F5, it is possible to fix an image in an extremely stable manner.

The heat resistant belt F3 is a ring-shaped endless belt, and it is would around the outer circumferences of the pressure roller F2 and the belt tension member F4 so that it can be moved with being held between the heat fixing roller F1 and the pressure roller F2 in a pressed state.

The heat resistant belt F3 is formed from a seamless tube having a thickness of 0.03 mm or more. Further, the seamless tube has a two layered structure in which its surface (which is the surface thereof that makes contact with the recording medium F5) is formed of PFA, and the opposite surface thereof (that is, the surface thereof that makes contact with the pressure roller F2 and the belt tension member F4) is formed of polyimide.

However, the structure of the heat resistant belt F3 is not limited to the structure described above, and it may be formed from other materials. Examples of tubes formed from other materials include a metallic tube such as a stainless tube or a nickel electrocasting tube, a heat-resistance resin tube such as a silicone tube, and the like.

The belt tension member F4 is disposed on the upstream side of the fixing nip part between the heat fixing roller F1 and the pressure roller F2 in the recording medium F5 conveying direction. Further, the belt tension member F4 is pivotally disposed about the rotation shaft F2*a* of the pressure roller F2 so as to be movable along the arrow P.

The belt tension member F4 is constructed so that the heat resistant belt F3 is extended with tension in the tangential direction of the heat fixing roller F1 in a state that the recording medium F5 does not pass through the fixing nip part. When the fixing pressure is large at an initial position where the recording medium F5 enters the fixing nip part, there is a case that the recording medium F5 can not enter the fixing nip part smoothly and thereby fixation is performed in a state that a tip part of the recording medium F5 is folded.

However, in this embodiment, the belt tension member F4 is provided so that the heat resistant belt F3 is extended with tension in the tangential direction of the heat fixing roller F1 as described above, there is formed an introducing portion for smoothly introducing the recording medium F5, so that the recording medium F5 can be introduced into the fixing nip part in a stable manner.

The belt tension member F4 is a roughly semi-circular member for slidably guiding the heat resistant belt F3 (that is, the heat resistant belt F3 slidably moves on the belt tension member F4). The belt tension member F4 is fitted into the inside of the heat resistant belt F3 so as to impart tension f to the heat resistant belt F3 in cooperation with the pressure roller F2.

The belt tension member F4 is arranged at a position where a nip part is formed by pressing a part of the heat resistant belt F3 toward the heat fixing roller F1 over the tangential line L on the pressing portion at which the heat fixing roller F1 is pressed against the pressure roller F2.

The protruding wall F4*a* is formed on any one or both of the end surfaces of the belt tension member F4 which are located in the axial direction thereof. The protruding wall F4*a* is provided for restricting the heat resistant belt F3 from being off to the side by abutment thereto in a case that the heat resistant belt F3 is deviated in any one of the sides.

Further, a spring F9 is provided between the frame and an end portion of the protruding wall F4*a* which is located at an opposite side from the heat fixing roller F1 so as to slightly press the protruding wall F4*a* of the belt tension member F4 against the heat fixing roller F1. In this way, the belt tension member F4 is positioned with respect to the heat fixing roller F1 in slidably contact with the heat fixing roller F1.

A position where the belt tension member F4 is slightly pressed against the heat fixing roller F1 is set as a nip starting position and a position where the pressure roller F2 is pressed against the heat fixing roller F1 is set as a nip ending position.

In the fixing unit F40, a recording medium F5 on which an unfixed toner image F5*a* is formed using the above liquid developing unit enters into the fixing nip part from the nip starting position, then passes between the heat resistant belt F3 and the heat fixing roller F1, and then exits from the nip ending position, and in this way an unfixed toner image F5*a* formed on the recording medium F5 is fixed.

Thereafter, the recording medium F5 on which the toner image is formed is fed out toward the tangential direction L of the pressing potion of the press roller F2 against the heat fixing roller F1.

The cleaning member F6 is disposed between the pressure roller F2 and the belt tension member F4. The cleaning member F6 is provided for cleaning foreign substances or wear debris on the inner surface of the heat resistant belt F3 by slidably contacting with the inner surface of the heat resistant belt F3.

By cleaning the foreign substances and wear debris in this way, it is possible to refresh the heat resistant belt F3 to eliminate the unstable factors on the frictional coefficients described above. Further, the belt tension member F4 is formed with a concave portion F4*f*, and this concave portion F4*f* is preferably used for collecting the foreign substances or wear debris eliminated from the heat resistant belt F3.

Further, the fixing unit F40 is provided with a removal blade (removal means) F12 for removing an insulation liquid adhering to or remaining on the surface of the heat fixing roller F1 after the toner image F5*a* has been fixed onto the recording medium F5. The insulation liquid removal blade F12 can not only remove the insulation liquid but also remove a toner or the like which has been transferred onto the heat fixing roller F1 at the same time upon fixation.

In order to stably drive the heat resistant belt F3 by the pressure roller F2 in a state that the heat resistant belt F3 is wound around the pressure roller F2 and the belt tension member F4, the frictional coefficient between the pressure roll F2 and the heat resistant belt F3 is set to be larger than the frictional coefficient between the belt tension member F4 and the heat resistant belt F3.

However, there is a case that these frictional coefficients become unstable due to entering of foreign substances between the heat resistant belt F3 and the pressure roller F2 or between the heat resistant belt F3 and the belt tension member F4, or due to the abrasion of the contacting part between the heat resistant belt F3 and the pressure roller F2 or the belt tension member F4.

Accordingly, the winding angle of the heat resistant belt F3 with respect to the belt tension member F4 is set to be smaller than the winding angle of the heat resistant belt F3 with respect to the pressure roller F2, and the diameter of the belt tension member F4 is set to be smaller than the diameter of the pressure roller F2.

With this structure, the distance that the heat resistant belt F3 moves on the belt tension member F4 becomes short so that unstable factors due to deterioration with the elapse of time and disturbance can be avoided or reduced. As a result, it is possible to drive the heat resistant belt F3 with the pressure roller F2 in a stable manner.

A fixing temperature which is applied to the toner images by the heat fixing roller F1 is preferably in the range of 80 to 200° C., more preferably in the range of 100 to 180° C., and even more preferably in the range of 100 to 150° C. The liquid developer of the present invention has superior fixing characteristics at a low temperature. Therefore, even if the fixing temperature is such a relatively low temperature, it is possible to fix the toner particles onto a recording medium firmly.

Second Embodiment of Image Forming Apparatus

Next, a description will be made with regard to a second embodiment of an image forming apparatus of the present invention.

Figure 5:
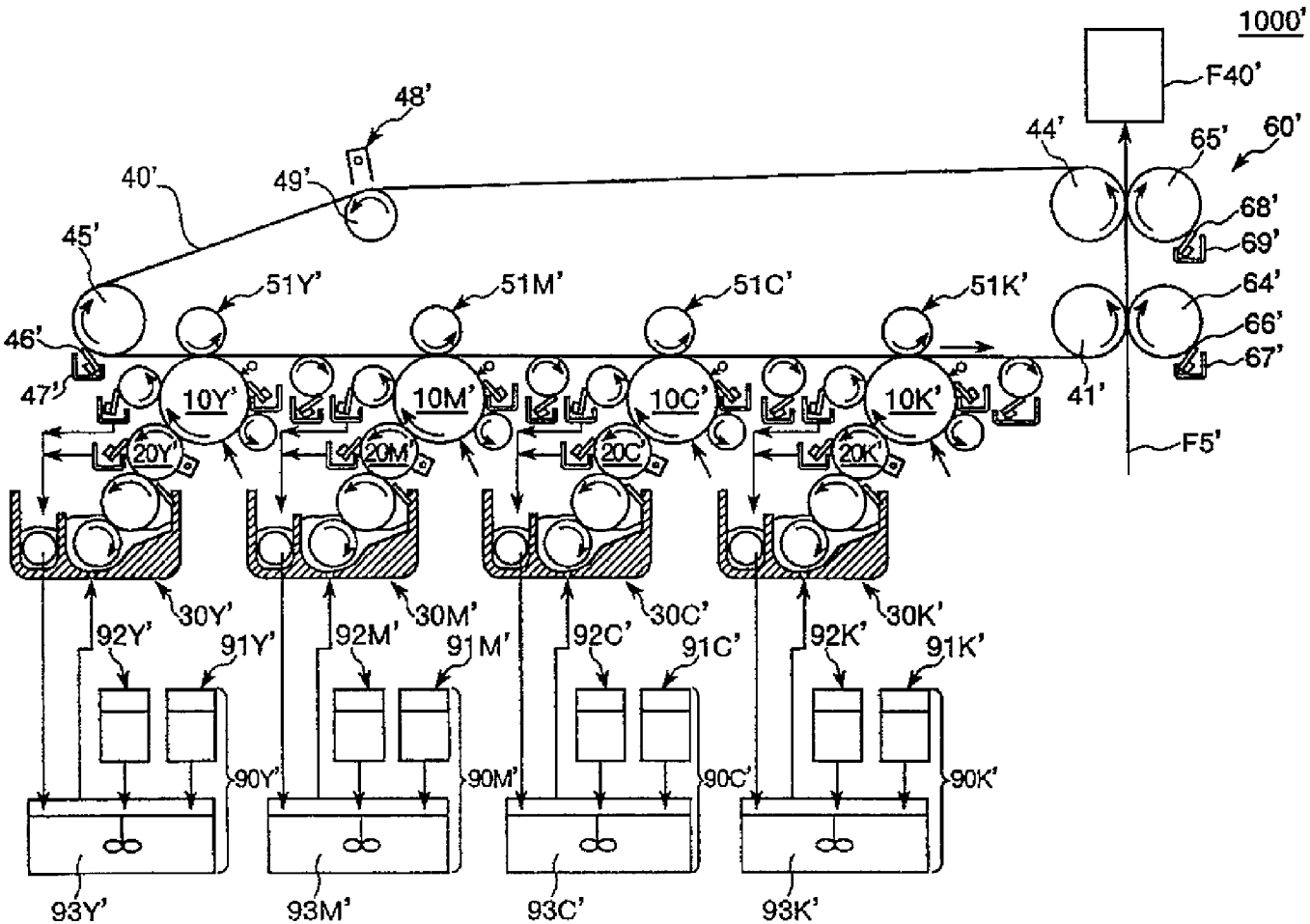
FIG. 5 is a schematic view which shows a second embodiment of an image forming apparatus to which a liquid developer of the present invention can be used.
Figure 6:
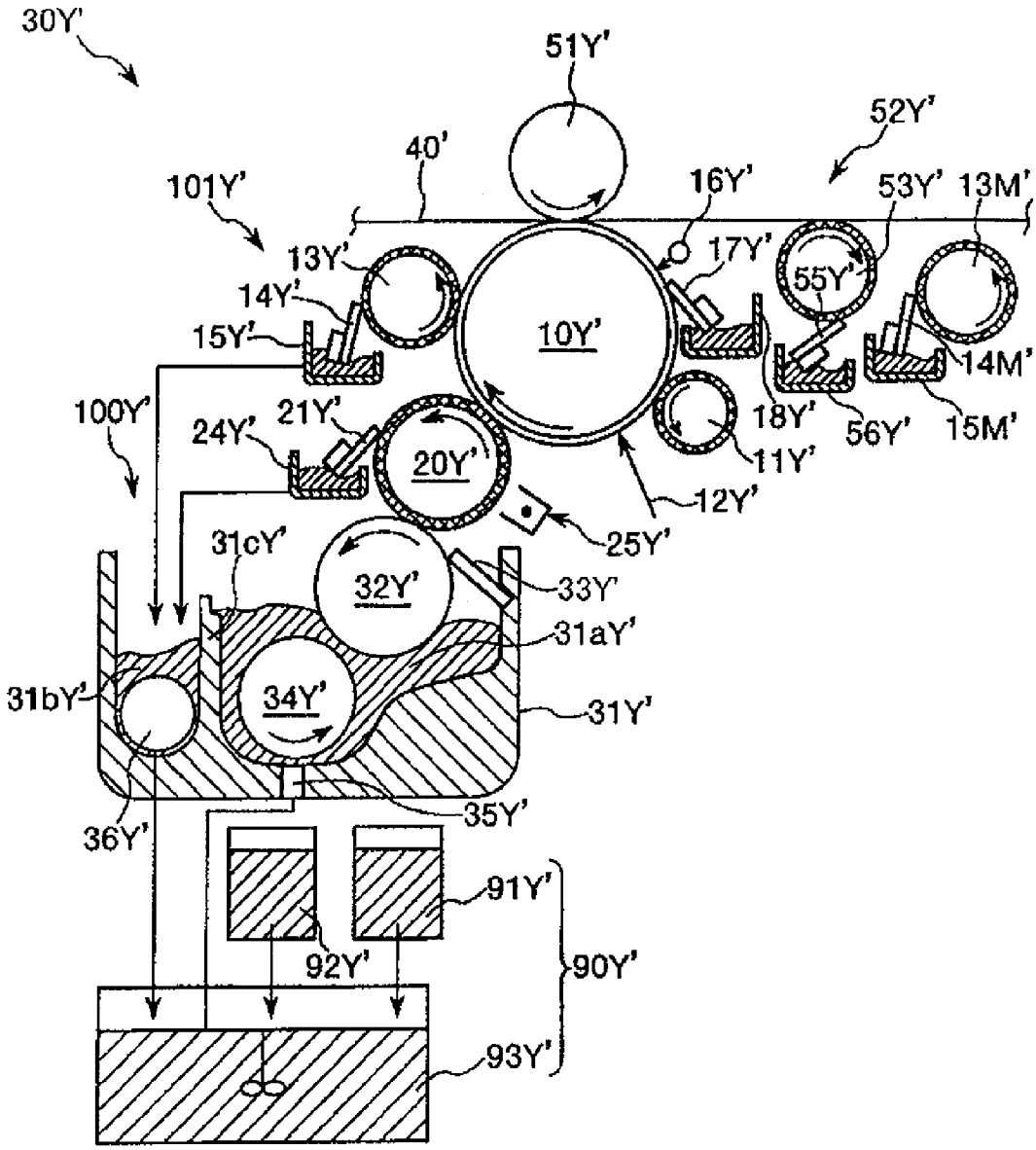
FIG. 6 is an enlarged view of a part of the image forming apparatus shown in FIG. 5.

FIG. 5 is a schematic view which shows a second embodiment of an image forming apparatus to which the liquid developer of the present invention can be used. FIG. 6 is an enlarged view of a part of the image forming apparatus shown in FIG. 5.

As shown in FIG. 5 and FIG. 6, the image forming apparatus 1000' includes four developing sections comprised of 30Y', 30C', 30M' and 30K', an intermediate transfer section 40', a secondary transfer unit (secondary transfer section) 60', a fixing section (fixing unit) F40' used in the first embodiment of the image forming apparatus and four liquid developer supply sections 90Y', 90C', 90M' and 90K'.

The developing sections 30Y', 30C' and 30M' contain respectively a yellow (Y) liquid developer, a cyan (C) liquid developer, and a magenta (M) liquid developer, and have the functions of developing latent images with the liquid developers to form monochromatic color images corresponding to the respective colors. Further, the developing section 30K' contains a black (K) liquid developer, and has the function of developing a latent image with the liquid developer to form a black monochromatic image.

The developing sections 30Y', 30C', 30M' and 30K' have the same structure. Therefore, in the following, the developing section 30Y' will be representatively described.

As shown in FIG. 6 the developing section 30Y' includes a photoreceptor 10Y' which carries a latent image and rotates in the direction of the arrow shown in the drawings. The image forming apparatus 1000' further includes an electrifying roller 11Y', an exposure unit 12Y', a developing unit 100Y', a photoreceptor squeeze device 101Y', a primary transfer backup roller 51Y', an electricity removal unit 16Y', a photoreceptor cleaning blade 17Y', and a developer collecting section 18Y', and they are arranged in the named order along the rotational direction of the photoreceptor 10Y'.

The photoreceptor 10Y' includes a cylindrical conductive base member and a photosensitive layer (both not shown in the drawings) which is constituted of a material such as amorphous silicon or the like formed on the outer peripheral surface of the base member, and is rotatable about the axis thereof in the clockwise direction as shown by the arrow in FIG. 5

The liquid developer is supplied onto the surface of the photoreceptor 10Y' from the developing unit 10Y' so that a layer of the liquid developer is formed on the surface.

The electrifying roller 11Y' is a device for uniformly electrifying the surface of the photoreceptor 10Y'. The exposure unit 12Y' is a device that forms an electrostatic latent image on the photoreceptor 10Y' uniformly by means of laser beam irradiation.

The exposure unit 12Y' includes a semiconductor laser, a polygon mirror, an F-θ lens, or the like, and irradiates a modulated laser beam onto the electrified photoreceptor 10Y' in accordance with image signals received from a host computer such as a personal computer, a word processor or the like not shown in the drawings.

The developing unit 100Y' is a device which develops the latent image to be visible with the liquid developer of the invention. The details of the developing unit 100Y' will be described later.

The photoreceptor squeeze device 101Y' is disposed so as to face the photoreceptor 10Y' at the downstream side of the developing unit 100Y' in the rotational direction thereof. The photoreceptor squeeze device 101Y' is composed from a photoreceptor squeeze roller 13Y', a cleaning blade 14Y' which is press contact with the photoreceptor squeeze roller 13Y' for removing a liquid developer adhering to the surface of the photoreceptor squeeze roller 13Y', and a developer collecting section 15Y' for collecting the removed liquid developer.

The photoreceptor squeeze device 101Y'has a function of collecting of an excess carrier (insulation liquid) and a fog toner which is inherently unnecessary from the liquid developer developed by the photoreceptor 10Y' to increase a ratio of the toner particles in the image to be formed.

The primary transfer backup roller 51Y' is a device for transferring a monochrome toner image formed on the photoreceptor 10Y' to the intermediate transfer section (belt) 40'.

The electricity removal unit 16Y' is a device for removing a remnant charge on the photoreceptor 10Y' after an intermediate image has been transferred to the intermediate transfer section 40' by the primary transfer backup roller 51Y'.

The photoreceptor cleaning blade 17Y' is a member made of rubber and provided in contact with the surface of the photoreceptor 10Y', and has a function of scrapping off the liquid developer remaining on the photoreceptor 10Y' after the image has been transferred onto the intermediate transfer section 40' by the primary transfer backup roller 51Y'.

The developer collecting section 18Y' is provided for collecting the liquid developer removed by the photoreceptor cleaning blade 17Y'.

The intermediate transfer section 40' is composed from an endless elastic belt which is wound around a belt drive roller 41' to which driving force is transmitted by a motor not shown in the drawings, a pair of driven rollers 44' and 45', and a tension roller 49'. The intermediate transfer section 40' is rotationally driven in the anticlockwise direction by the belt drive roller 41' while being in contact with the photoreceptors 10Y', 10M', 10C' and 10K' at each of positions that the primary transfer backup rollers 51Y', 51C', 51M' and 51K' are in contact with an intermediate transfer belt (feed belt).

The intermediate transfer section 40' is constructed so that a predetermined tension is given by the tension roller 49' to prevent loosening of the endless elastic belt. The tension roller 49' is disposed at the downstream side of the intermediate transfer section 40' in the moving direction thereof with respect to one driven roller 44' and at the upstream side of the intermediate transfer section 40' in the moving direction thereof with respect to the other driven roller 45'.

Monochromatic images corresponding to the respective colors formed by the developing sections 30Y', 30C', 30M' and 30K' are sequentially transferred by the primary transfer backup rollers 51Y', 51C', 51M' and 51K' so that the monochromatic images corresponding to the respective colors are overlaid, thereby enabling a full color toner image (intermediate transferred image) to be formed on the intermediate transfer section 40' which will be described later.

The intermediate transfer section 40' carries the monochromatic images formed on the respective photoreceptors 10Y', 10M', 10C' and 10K' in a state that these images are successively secondary-transferred onto the belt so as to be overlaid one after another, and the overlaid images are transferred onto a recoding medium F5' such as paper, film and cloth as a single color image in the secondary transfer unit 60' described later.

In the meantime, when the toner image is transferred onto the recording medium F5' in the secondary transfer process, there is a case that the recording medium F5 is not a flat sheet material due to fibers thereof. The elastic belt is employed as a means for increasing secondary transfer characteristics for such a non-flat sheet material.

Further, the intermediate transfer section 40' is also provided with a cleaning device which is composed form an intermediate transfer section cleaning blade 46', a developer collecting section 47' and a non-contact type bias applying member 48'.

The intermediate transfer section cleaning blade 46' and the developer collecting section 47' are arranged on the side of the driven roller 45'.

The intermediate transfer section cleaning blade 46' has a function of scrapping off of the liquid developer adhering to the intermediate transfer section 40' to remove it after the image has been transferred onto a recording medium F5' by the secondary transfer unit (secondary transfer section) 60'.

The developer collecting section 47' is provided for collecting the liquid developer removed by the intermediate transfer section cleaning blade 46'.

The non-contact type bias applying member 48' is disposed so as to be apart from the intermediate transfer section 40' at an opposite position of the tension roller 49' through the intermediate transfer section (that is, elastic belt) 40'.

The non-contact type bias applying member 48' applies a bias voltage having a reversed polarity with respect to a polarity of the toner particles to each of the toner particles (solid content) contained in the liquid developer remaining on the intermediate transfer section 40' after the image has been secondary-transferred onto the recording medium F5'. This makes it possible to remove electricity from the remaining toner particles so that it is possible to lower electrostatic adhesion force of the toner particles to the intermediate transfer section 40'. In this embodiment, a corona electrification device is used as the non-contact type bias applying member 48'.

In this regard, it is to be noted that the non-contact type bias applying member 48' may not be necessarily disposed at the opposite position of the tension roller 49' through the intermediate transfer section (that is, elastic belt) 40'.

For example, the non-contact type bias applying member 48' may be disposed at any position between the downstream side of the intermediate transfer section 40' in the moving direction thereof with respect to one driven roller 44' and the upstream side of the intermediate transfer section 40' in the moving direction thereof with respect to the other driven roller 45' such as any position between the driven roller 44' and the tension roller 49'.

Note that as the non-contact type bias applying member 48', various known non-contact type electrification devices other than the corona electrification device may be employed.

An intermediate transfer second squeeze device 52Y' is provided at the downstream side of the primary transfer backup roller 51Y' in the moving direction of the intermediate transfer section 40' (see FIG. 6).

The intermediate transfer squeeze device 52Y' is provided as a means for removing an excess amount of the insulation liquid from the transferred liquid developer in the case where the liquid developer transferred onto the intermediate transfer section 40' does not have a desired dispersion state.

As shown in FIG. 6, the intermediate transfer squeeze device 52Y' includes an intermediate transfer squeeze roller 53Y', an intermediate transfer squeeze roller cleaning blade 55Y' which is in press contact with the intermediate transfer squeeze roller 53Y' for cleaning the surface thereof, and a liquid developer collecting section 56Y' which collects the liquid developer removed from the intermediate transfer squeeze roller 53Y' by the intermediate transfer squeeze roller cleaning blade 55Y'.

The intermediate transfer squeeze device 52Y' has a function of collecting an excess insulation liquid from the liquid developer primary-transferred to the intermediate transfer section 40' to increase a ratio of the toner particles in an image to be formed and collecting a fog toner which is inherently unnecessary.

The secondary transfer unit 60' is provided a pair of secondary transfer rollers 64' and 65' which are arranged so as to depart from a predetermined distance each other along in the moving direction of the recording medium F5'. Among a pair of the secondary transfer rollers 64' and 65', the upstream side secondary transfer roller 64' is arranged upstream side of the intermediate transfer section 40' in the rotational direction thereof. This upstream side secondary transfer roller 64' is capable of press contact with the belt drive roller 41' through the intermediate transfer section 40'.

Among a pair of the secondary transfer rollers 64' and 65', the downstream side secondary transfer roller 65' is arranged at a downstream side of a recording medium F5' in the moving direction thereof. This downstream side secondary transfer roller 65' is capable of press contact to the recording medium F5' with the driven roller 44' through the intermediate transfer belt.

Namely, the intermediate transfer images which are formed on the intermediate transfer section 40' by overlaying the transferred monochromatic color images in state that the recording medium F5' is in contact with the intermediate transfer section 40' which wound around the belt drive roller 41' and the driven rollers 44' and goes through between the driven roller 44' and the downstream side secondary transfer roller 65' and between the belt driven roller 41' and the upstream side secondary transfer roller 64' are secondary-transferred on the recording medium F5'.

In this case, the belt driven roller 41' and the driven roller 44' have a function as the upstream side secondary transfer roller 64' and the downstream side secondary transfer roller 65' respectively.

Namely, the belt driven roller 41' is also used as an upstream side backup roller arranged at the upstream side of the recording medium F5' to the driven roller 44' in the moving direction thereof in the secondary transfer unit 60'.

The driven roller 44' is also used as a downstream side backup roller arranged in the downstream side of the recording medium F5' to the belt driven roller 41' in the moving direction thereof in the secondary transfer unit 60'.

The recording medium F5' which have conveyed to the secondary transfer unit 60' is allowed to adhere to the intermediate transfer belt at positions between the upstream side secondary transfer roller 64' and the belt driven roller 41' (nip starting position) and between the downstream side secondary transfer roller 65' and the driven roller 44' (nip ending position).

Since this make it possible to second-transfer the intermediate transfer images of full-color on the intermediate transfer section 40' to the recording medium F5 with adhesion to the intermediate transfer section 40' for a predetermined period of time, it is possible to second-transfer the intermediate images reliably.

The secondary transfer unit 601 is provided a secondary transfer roller cleaning blade 66' and a developer collecting section 67' with respect to the upstream side secondary transfer roller 64'. The secondary transfer unit 60' is also provided a secondary transfer roller cleaning blade 68' and a developer collecting section 69' with respect to the downstream side secondary transfer roller 65'.

Each of the secondary transfer roller cleaning blades 66' and 68' is in contact with the upstream side secondary transfer roller 64' and the downstream side secondary transfer roller 65' to secondary-transfer. After the second-transfer, the liquid developer remaining on the surfaces of each of the upstream side secondary transfer roller 64' and the downstream side secondary transfer roller 65' is scrapped off by the secondary transfer roller cleaning blades 66' and 68' and removed from each of the upstream side secondary transfer roller 64' and the downstream side secondary transfer roller 65'.

The liquid developer scrapped off the surfaces of each of the upstream side secondary transfer roller 64' and the downstream side secondary transfer roller 65' by each of the secondary transfer roller cleaning blades 66' and 68' is collected and preserved by each of the developer collecting sections 67' and 69'.

A toner image (transferred image) F5*a*' transferred onto the recording medium F5' by the secondary transfer section 60' is fed to a fixing unit (fixing device) F40' (which will be described later), where the unfixed toner image is fixed onto the recoding medium F5.

Hereinbelow, a detailed description will be made with regard to the developing units 100Y', 100C', 100M' and 100K'. In this regard, it is to be noted that since the developing units 100Y', 100C', 100M' and 100K' have the same structure, in the following description the developing section 100Y' will be representatively described.

As shown in FIG. 6, the developing unit 100Y' includes a liquid developer storage section 31Y', an application roller 32Y', a regulating blade 33Y', a liquid developer stirring roller 34Y', a communicating section 35Y', a collecting screw 36Y', a developing roller 20Y', a developing roller cleaning blade 21Y' and a corona electrification device (pressing means) 25Y'.

The liquid developer storage section 31Y' is provided for storing a liquid developer for developing a latent image formed on the photoreceptor 10Y'.

Such a liquid developer storage section 31Y' includes a supply section 31*a*Y' for supplying the liquid developer onto the application roller 32Y', a collecting section 31*b*Y' for collecting an excess liquid developer in the supply section 31*a*Y', the developer collecting section 15Y' and a developer collecting section 24Y' and a partition 31*c*Y' for partitioning between the supply section 31*a*Y' and the collecting section 31*b*Y'.

The supply section 31*a*Y' is provided for supplying the liquid developer onto the application roller 32Y' and has a concave portion in which a liquid developer stirring roller 34Y' is provided. Further, the liquid developer is supplied from the liquid developer mixing bath 93Y' to the supply section 31*a*Y' through the communicating section 35Y'.

The collecting section 31*b*Y' is provided for collecting the liquid developer excessively supplied to the supply section 31*a*Y' and the excess liquid developer collected in the developer collecting sections 15Y' and 24Y'. The collected liquid developer is fed to the liquid developer mixing bath 93Y' as described later and it is then reused.

Further, the collecting section 31*b*Y' has a concave portion in which the collecting screw 36Y' is provided in the vicinity of a bottom thereof.

A wall-like partition 31*c*Y' is provided between the supply section 31*a*Y' and the collecting section 31*b*Y'. The wall-like partition 31*c*Y' can partition between the supply section 31*a*Y' and the collecting section 31*b*Y'. And the partition 31*c*Y' can prevent the liquid developer collected in the developer collecting sections 15Y' and 24Y' from being mixed to the flesh liquid developer in the supply section 31*a*Y'.

When the liquid developer is excessively supplied from the liquid developer mixing bath 93Y' to the supply section 31*a*Y', the excess liquid developer is spilled from the supply section 31*a*Y' into the collecting section 31*b*Y' over the partition 31*c*Y'. Therefore, it is possible to maintain a constant amount of the liquid developer in the supply section 31*a*Y', thereby maintaining a constant amount of the liquid developer to be supplied to the application roller 32Y'. As a result, it becomes possible to provide a constant image quality of the finally obtained images.

Further, a notch is provided in the partition 31*c*Y'. The liquid developer in the supply section 31*a*Y' can spill from the supply section 31*a*Y' into the collecting section 31*b*Y' over the notch.

The application roller 32Y' has the function of supplying the liquid developer to the developing roller 20Y'. As shown in FIG. 6, the application roller 32Y' is of the type so-called as "Anilox Roller" which is constructed from a metallic roll made of iron or the like of which surface has grooves formed regularly and helically, and a nickel plating formed on the surface.

The diameter of the roller is about 25 mm. As described above embodiment, in this embodiment, a number of grooves 32Y' are formed inclinedly with respect to the rotational direction by means of a cutting process or rolling process.

The application roller 32Y' rotates in an anti-clockwise direction and makes contact with the liquid developer so that the liquid developer stored in the supply section 31*a*Y' of the liquid developer storage section 31Y' is carried by the grooves, and the carried liquid developer is then conveyed to the developing roller 20Y'.

The regulating blade 33Y' is provided in contact with the surface of the application roller 32Y' for regulating an amount of the liquid developer carried on the application roller 32Y'. Specifically, the regulating blade 33Y' scrapes away an excess amount of the liquid developer on the application roller 32Y' so that an amount of the liquid developer to be supplied onto the developing roller 20Y' by the application roller 32Y' can be regulated.

The regulating blade 33Y' is formed from an elastic body made of an urethane rubber, and supported by a regulating blade supporting member made of a metal such as iron or the like. Further, the regulating blade 33Y' is arranged on the side where the application roller 32Y' comes out of the liquid developer with its rotation (that is, on the right side in FIG. 6).

In this regard, it is to be noted that the rubber hardness of the regulating blade 33Y', that is, a rubber hardness (77) of a portion of the regulating blade 33Y' which in press contact with the surface of the application roller 32Y' is about 77 according to JIS-A.

The rubber hardness (77) of the regulating blade 33Y' is lower than the rubber hardness of an elastic layer of the developing roller 20Y' (described later) which is a rubber hardness (about 85) of a portion of the developing roller 20Y' which is in press contact with the surface of the application roller 32Y'.

Further, the excess amount of the liquid developer scraped off by the regulating blade 33Y' is collected in the supply section 31*a*Y' and it is then reused.

The liquid developer stirring roller 34Y' has a function of stirring the liquid developer so as to be homogeneously dispersed. By providing such a liquid developer stirring roller 34Y', even when the toner particles 1 are aggregated in the supply section 31*a*Y', it is possible to disperse the toner particles 1 preferably.

In the supply section 31*a*Y', the plurality of toner particles 1 of the liquid developer are positively charged. The liquid developer is stirred by the liquid developer stirring roller 34Y' to be a homogeneously dispersed state, and such a liquid developer is dipped from the supply section 31*a*Y' according to the rotation of the application roller 32Y' so that the liquid developer is supplied onto the developing roller 20Y' with the amount of the liquid developer being regulated by the regulating blade 33Y'.

Further, the stirring by the liquid developer stirring roller 34Y' makes it possible to reliably supply the liquid developer in the supply section 31*a*Y' to the collecting section 31*b*Y' over the notch. Therefore, it is possible to prevent an excess amount of the liquid developer from remaining in the supply section 31*a*Y'. It is also possible to prevent the toner particles contained in the liquid developer from aggregating in the supply section 31*a*Y'.

Furthermore, the liquid developer stirring roller 34Y' is provided in the supply section 31*a*Y' in the vicinity of the communicating section 35Y'. Therefore, it is possible to quickly diffuse the liquid developer supplied from the liquid developer mixing bath 93Y' through the communicating section 35Y'.

As a result, even in the case where the liquid developer is being supplied from the liquid developer mixing bath 93Y' to the supply section 31*a*Y', it is possible to maintain the stable surface of the liquid developer in the supply section 31*a*Y'.

Since such a liquid developer stirring roller 34Y' is provided in the supply section 31*a*Y' in the vicinity of the communicating section 35Y', a pressure in the supply section 31*a*Y' is lower than a pressure in the liquid developer mixing bath 93Y'. Therefore, the liquid developer is naturally supplied from the liquid developer mixing bath 93Y' to the supply section 31*a*Y' through the communicating section 35Y'.

The communicating section 35Y' is provided below the liquid developer stirring roller 34Y' in the liquid developer storage section 31Y'. Further, the communicating section 35Y' is in communication with the liquid developer mixing bath 93Y' through feeding means (not shown in FIG. 6). The communicating section 35Y' is a part through which the liquid developer is supplied from the liquid developer mixing bath 93Y' to the supply section 31*a*Y'.

Since the communicating section 35Y' is provided below the liquid developer stirring roller 34Y' in the liquid developer storage section 31Y', it is difficult for the liquid developer to enter into the supply section 31*a*Y' through the communicating section 35Y'. Therefore, no ruffle is observed on the surface of the liquid developer by the reverse flow of the liquid developer thorough the communicating section 35Y'. As a result, it is possible to maintain the stable surface of the liquid developer in the supply section 31*a*Y', thereby enabling the liquid developer to be supplied to the application roller 32Y' reliably.

The collecting screw 36Y' which is provided in the vicinity of the bottom of the collecting section 31*b*Y' is made of a cylindrical member and has a helically rib on a outer circumferential thereof. Further, the collecting screw 36Y' has a function of keeping fluidity of the liquid developer collected from the developer collecting sections 15Y' and 24Y'. Furthermore, the collecting screw 36Y' also has a function of facilitating supply of the liquid developer to the liquid developer mixing bath 93Y'.

The developing roller 20Y' is provided for conveying the liquid developer to a developing position opposed to the photoreceptor 10Y' in order to develop a latent image carried on the photoreceptor 10Y' with the liquid developer.

The liquid developer from the application roller 32Y' is supplied onto the surface of the developing roller 20Y' so that a layer of the liquid developer 201Y' is formed on the surface.

The developing roller 20Y' includes an inner core member made of a metal such as iron or the like and an elastic layer having conductivity and provided onto an outer periphery of the inner core member. The diameter of the developing roller 20Y' is about 20 mm.

The elastic layer has a two layered structure which includes an inner layer made of urethane rubber and an outer layer (surface layer) made of urethane rubber. The inner layer has a rubber hardness of 30 according to JIS-A and a thickness of about 5 mm, and the outer layer has a rubber hardness of about 85 according to JIS-A and a thickness of about 30 μm.

The developing roller 20Y' is in press contact with both the application roller 32Y' and the photoreceptor 10Y' in a state that the outer layer of the developing roller 20Y' is elastically deformed.

The developing roller 20Y' is rotatable about its central axis, and the central axis is positioned below the central axis of the photoreceptor 10Y'. Further, the developing roller 20Y' rotates in a direction (clockwise direction in FIG. 6) opposite to the rotational direction (anti-clockwise direction in FIG. 6) of the photoreceptor 10Y'.

It is to be noted that an electrical field is generated between the developing roller 20Y' and the photoreceptor 10Y' when a latent image formed on the photoreceptor 10Y' is developed.

The corona electrification device (pressing means) 25Y' is a device having a function of pressing toner particles of the liquid developer carried by the developing roller 20Y'. In other words, the corona electrification device 25Y' is a device that applies an electrical field of the same polarity as a toner particle 1 to the liquid developer layer 201Y' described above to thereby unevenly distribute the toner particles at the vicinity of the developing roller 20Y' in the liquid developer layer 201Y' as shown in FIG. 3.

By unevenly distributing the toner particles in this way, it is possible to improve an image density (developing efficiency), and as a result it becomes possible to obtain a high quality clear image.

In this regard, it is to be noted that the application roller 32Y' is driven by a power source (not shown) which is difference from a power source for driving the developing roller 20Y'. Therefore, by changing a rotational speed (linear velocity) ratio of each of the application roller 32Y' and the developing roller 20Y', it is possible to adjust an amount of the liquid developer to be supplied onto the developing roller 20Y'.

The developing unit 100Y' has a developing roller cleaning blade 21Y' made of rubber and provided in contact with the surface of the developing roller 20Y' and a developer collecting section 24Y'. The developing roller cleaning blade 21Y' is a device for scrapping off the liquid developer remaining on the developing roller 20Y' after the development of an image has been carried out at the developing position. The liquid developer removed by the developing roller cleaning blade 21Y' is collected in the developer collecting section 24Y'.

As shown in FIG. 5 and FIG. 6, the image forming apparatus 1000' is provided with liquid developer supply sections 90Y', 90M', 90C' and 90K' which supply the liquid developers to the developing sections 30Y', 30M', 30C' and 30K', respectively.

The liquid developer supply sections 90Y', 90M', 90C' and 90K' have the same structure, respectively. Namely, the liquid developer supply sections 90Y', 90M', 90C' and 90K' are provided with liquid developer tanks 91Y', 91M', 91C' and 91K', insulation liquid tanks 92Y', 92M', 92C' and 92K' and liquid developer mixing baths 93Y', 93M', 93C' and 93K', respectively.

In each of the liquid developer tanks 91Y/, 91M' 91C' and 91K', a liquid developer of high concentration which corresponds to each of the different colors is stored.

Further, in each of the insulation liquid tanks 92Y', 92M', 92C' and 92K', the insulation liquid is stored.

Further, each of the liquid developer mixing baths 93Y', 93M', 93C' and 93K' is constructed so that a predetermined amount of the high concentration liquid developer is supplied from each of the corresponding liquid developer tanks 91Y', 91M', 91C' and 91K' and a predetermined amount of the insulation liquid is supplied from each of the corresponding insulation liquid tanks 92Y', 92M', 92C' and 92K'.

In each of the liquid developer mixing baths 93Y', 93M', 93C' and 93K', the supplied high concentration liquid developer and the supplied insulation liquid are mixed by a provided stirring device with being stirred to prepare the liquid developers corresponding to different colors which are to be used in the supply sections 31*a*Y', 31*a*M', 31*a*C' and 31*a*K', respectively. The liquid developers prepared in the respective liquid developer mixing baths 93Y', 93M', 93C' and 93K' in this way are supplied to the corresponding supply sections 31*a*Y', 31*a*M', 31*a*C' and 31*a*K', respectively.

Further, the liquid developers collected in the respective collecting sections 31*b*Y', 31*b*M', 31*b*C' and 31*b*K' are respectively collected to the liquid developer mixing baths 93Y', 93M', 93C' and 93K' and then they are reused.

In this regard, it is to be noted that a description of the fixing section F40' is omitted since it has the same structure as that in the first embodiment of the image forming apparatus described above.

In the foregoing, the invention was described based on the preferred embodiments, but the invention is not limited to these embodiments.

For example, the liquid developer of the present invention is not limited to one that is to be used in the image forming apparatuses and the fixing unit as described above. Further, the liquid developer of the present invention is not limited to one produced by the method described above.

Further, in the above described embodiments, an electrolyte is added to the water-based emulsion obtained by adding the resin solution to the aqueous solution so that the particles of the dispersoid are associated to thereby form associated particles. But the present invention is not limited thereto.

For example, a coloring agent, a monomer of a polyester resin, a surfactant and a polymerization initiator are dispersed in the water-based liquid, and a water-based emulsion is prepared by an emulsion polymerization, and then an electrolyte is added to the water-based emulsion, so that the particles of the dispersoid are associated to thereby form associated particles (this method is called as "emulsion polymerization association method"). Further, the obtained water-based emulsion is dried by a spry to thereby obtain associated particles.

In this regard, it is to be noted that the associated particles are disassociated in the fatty acid monoester in the embodiment described above, but the associated particles may be disassociated in a mixture solution in which the fatty acid monoester is mixed with the other components constituting the insulation liquid. Even when the associated particles are disassociated in such a mixture solution, it is possible to obtain the effects as described above.

Further, it is to be noted that the insulation liquid contains the fatty acid monoester and the other components in the embodiment described above, but in the case where the insulation liquid is constituted of only the fatty acid monoester, it is possible to omit the mixing step described above from the steps for producing the liquid developer.

EXAMPLES

1 Production of Liquid Developer

Example 1

Preparation of Coloring Agent Master Solution

First, a mixture of a polyester resin R1 (a weight-average molecular weight Mw was 45,600, a number-average molecular weight Mn was 27,200, Mw/Mn=1.68, a glass transition temperature Tg was 48° C., and a softening point Tf thereof was 108° C.) as a resin material and a cyanine pigment ("Pigment Blue 15:3", produced by Dainichiseika Color & Chemicals Mfg. Co., Ltd.) as a coloring agent were prepared. These components were mixed at a mass ratio of 50:50 using a 20 L type Henschel mixer to obtain a material for producing toner particles.

Next, the material (mixture) was kneaded using a biaxial kneader-extruder. The kneaded material extruded from an extruding port of the biaxial kneader-extruder was cooled. The kneaded material that had been cooled as described above was coarsely ground using a hammer mill to be formed into powder having an average particle size of 1.0 mm or less.

Methylethylketone was added to the powder of the kneaded material obtained so that an amount of the powder of the kneaded material (polyester resin and pigment) became 30 wt % and then the mixture was subjected to a wet dispersion process with an aigar motor mill ("M-1000" produced by American Aigar Co., Ltd.) to prepare a coloring agent master solution.

Preparation of Resin Solution 200 parts by weight of methylethylketone and 73 parts by weight of the polyester resin R1 were added into 33 parts by weight of the coloring agent master solution to obtain a mixture and then the mixture was stirred with an aigar motor mill ("M-1000" produced by American Aigar Co., Ltd.) to obtain a resin solution. In the resin solution, the pigment was finely dispersed homogeneously.

Preparation of Water-Based Emulsion 500 parts by weight of the resin solution and 45.5 parts by weight of methylethylketone were put into a cylindrical separable flask of 2 L having a maxblend stirring blade. It is to be noted that an amount of a solid content, namely, the pigment, the polyester resin derived from the coloring agent master solution and the polyester derived from the resin solution contained in the resin solution was 55%.

Next, 41.7 parts by weight of 1N ammonia water (a mol equivalent ratio of ammonia to a total amount of carboxyl groups that the polyester resin had in a molecular structure thereof was 1.1) was added to the resin solution in the separable flask to obtain a mixture. Then, the mixture was sufficiently stirred by a three one motor (produced by SHINTO Scientific Co., ltd.) under the conditions that a rotation number of a stirring blade was 210 rpm and a peripheral velocity of the stirring blade was 0.71 m/s. Thereafter, 133 parts by weight of deionized water was added into the separable flask while stirring the mixture.

Next, additional 133 parts by weight of deionized water was added to the resin solution in the separable flask drop by drop under the conditions that the temperature of the mixture in the separable flask was adjusted at 25° C. and the mixture was continued to be stirred to thereby cause phase inversion emulsification. In this way, a water-based emulsion in which a dispersoid containing the polyester resin was dispersed was obtained.

Produce of Associated Particles

Next, in a state that the stirring of the water-based emulsion in the flask was still being continued, 285 parts by weigh of deionized water was further added to the water-based emulsion so that a total amount of 1N ammonia water and water became 593 parts by weight. Then, 2.6 parts by weight of EMAL O (an anion type emulsifying agent produced by Kao Corporation) which was diluted by 30 parts by weight of deionized water was added into the water-based emulsion.

Thereafter, 300 parts by weight of 3.5% ammonium sulfate solution was added into the water-based emulsion drop by drop under the conditions that a temperature of the water-based emulsion was kept to be at 25° C., a rotation number of a stirring blade was 150 rpm, and a peripheral velocity of the stirring blade was 0.54 m/s. In this way, a particle size of an associated particle became 3.5 μm.

After the addition of the ammonium sulfate solution to the water-based emulsion was ended, the water-based emulsion was still continued to be stirred until the particle size of the associated particle became 5.0 μm to obtain an associated particle dispersion liquid. In this way, the production process of the associated particles was completed. The associated particle dispersion liquid was dried under reduced pressure to remove the organic solvent (methylethylketone) to thereby obtain associated particles of the dispersoid.

In this regard, it is to be noted that an average particle size of the associated particles and an average particle size of the toner particles obtained in each of the Examples 1 to 13 and the Comparative Examples 1 to 6 were measured in the volume basis with a particle analysis apparatus ("Mastersizer 2000" produced by Malvern Instruments Ltd.). Further, a particle size distribution of the associated particle and a particle size distribution of the toner particles were also measured with the same particle analysis apparatus.

A glass transition temperature Tg of the associated particles obtained as described above was measured by using a differential scanning calorimeter (DSC) as described below. As a result, the glass transition temperature Tg of the associated particles was 48° C.

Preparation of Liquid Developer 40 g of the thus obtained associated particles, 60 g of a soy oil ester-exchange liquid (viscosity was 5.1 mPa·s, "soy oil fatty acid methyl" produced by The Nisshin OilliO Group, Ltd.) which was obtained by a ester-exchange reaction the soy oil and methanol, 2.0 g a dispersant represented by the following chemical structural formula (VI) and 3.0 parts by weight of aluminum stearate (produced by NOF CORPORATION) were put in a ceramics pot (volume is 600 ml). Then zirconia balls each having the diameter of 1 mm was added in the ceramics pot so that a volume filling factor thereof became 30%.

They were then mixed by a desk pot mill at a rotational speed of 220 rpm for 24 hours for disassociating the associated particles, to thereby obtain a toner particle dispersion liquid.

(VI)

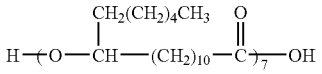

Thereafter, 90 g of higholeic rape oil ("higholec rape oil", produced by The Nisshin OilliO Group, Ltd.) was added into the toner particle dispersion liquid. They were then mixed by the desk pot mill at a rotational speed of 220 rpm for 24 hours for diluting and dispersing the mixture, to thereby obtain a liquid developer.

An average particle size of the toner particles in the thus obtained liquid developer was 1.5 μm. A standard deviation of the particle size in each of the toner particles was 0.65 μm. Further, a viscosity of the liquid developer measured according to JIS Z8809 using a vibration type viscometer at a temperature of 25° C. was 247 mPa·s. Furthermore, an electric resistance of the liquid developer was $2.8\times10^{12}$ Ωcm.

The thus obtained liquid developer was filtered, and then a glass transition temperature Tg of the toner particles (resin material) was measured by using DSC as described below. As a result, the glass transition temperature Tg of the toner particles was 25° C.

Furthermore, a magenta liquid developer, a yellow liquid developer, and a black liquid developer which were the same as those described above were produced excepting that a pigment red 122 as a magenta pigment, a pigment yellow 180 as a yellow pigment, and a carbon black ("Printex L", produced by Degussa AG) as a black pigment were respectively used instead of the cyanine pigment.

Examples 2 to 8

In Examples 2 to 8, liquid developers of different colors were produced in the same manner as in the Example 1 except that a kind of used resin material, kind of used insulation liquid, the amounts of the resin material and the insulation liquid and the like were changed to those shown in Table 1.

Comparative Examples 1 to 5

In Comparative Examples 1 to 5, liquid developers of different colors were produced in the same manner as in the Example 1 except that a kind of used resin material, kind of used insulation liquid, the amounts of the resin material and the insulation liquid and the like were changed to those shown in Table 1.

In the Examples 1 to 8 and the Comparative Examples 1 to 5, the following data were shown in Table 1: the data of each resin material which include the kind of used resin material, the weight-average molecular weight Mw, the amount of the component of which molecular weight M is 10,000 or less, a ratio Mw/Mn between the weight-average molecular weight Mw and the number-average molecular weight Mn (index of the distribution of the molecular weight), the glass transition temperature Tg, and the softening point Tf; the data of the toner particles which include the glass transition temperature Tg of the toner particles dispersed in each liquid developer, and the difference ΔTg (=Tg(2)−Tg(1)) between the glass transition temperature Tg (Tg(1)) of the associated particles in a state that the associated particles were not disassociated in each liquid developer and the glass transition temperature Tg (Tg(2)) of the toner particles in a state that the toner particles were dispersed in each liquid developer; the data of the fatty acid monoester which include a kind of fatty acid monoester, the alcohol component of fatty acid monoester and the amount (X) of fatty acid monoester in each insulation liquid; the data of the main component other than the fatty acid monoester which include the kind thereof and the amount (Y) thereof; and the data of the dispersant which include the kind of dispersant and the amount of the dispersant with respect to the toner particles of 100 parts by weight.

In each of the Examples 1 to 8 and the Comparative Examples 1 to 5 in Table 1, a sample solution of the obtained liquid developer was subjected to a gel permeation chromatography under the following conditions.

The conditions were set so that High Speed GPC system ("HLC-8220GPC" including R1/UV-8220 produced by TOSOH CORPORATION) was used as an apparatus for the gel permeation chromatography, four columns, namely TSK-gel SuperHZM-Ms (the inside diameter was 4.6 mm, the length was 15 cm) were used, a temperature of each of the four columns was 40° C., a dissolution liquid was tetrahydrofuran of a special grade (produced by KANTO CHEMICAL CO., INC.), a flow rate of the dissolution liquid was 0.35 ml/min, sample concentration was 1 mg/ml, an injection amount of the sample solution was 20 μl, and a standard material was standard polystyrene (produced by TOSOH CORPORATION).

In this regard, it is to be noted that the sample solution was subjected to a pre-treatment as follows. A resin material contained in the toner particles taken out from the liquid developer was dissolved by tetrahydrofuran to a mixture. Then the mixture was left a whole day and night. Thereafter, the left mixture was filtered by using a syringe filter having a pore size of 0.2 μm to obtain a filtrate as the sample solution.

Further, the glass transition temperatures Tg of the resin material and the toner particles dispersed in the liquid developer in Table 1 were measured under the following conditions by using DSC ("DSC-220C" produced by Seiko Instruments Inc.) as a measurement apparatus.

The conditions were set so that 10 mg of the resin material was added to an aluminum pan, a temperature raising speed was 10° C./min and a measurement temperature was in the range of 30 to 150° C. The measurement was carried out two times under the same conditions. The first round of the measurement was carried out at a raising and falling temperature of 10° C. to 150° C. to 10° C. The second round of the measurement was carried out under the same conditions as those of the first round of the measurement. In this regard, it was to be noted that the data of the second round of the measurement was used as each of the glass transition temperatures in Table 1.

In this regard, it is to be noted that the softening point Tf of the resin material in Table 1 was measured under the conditions that a temperature raising speed is 5° C./min and a diameter of a die hole is 1.0 mm in a high-floored flow tester (produced by Shimadzu Corporation) as a measurement apparatus.

In this regard, it is to be noted that the laurate ethyl refers to a laurate monoester which was obtained by the ester-exchange reaction between lauric acid and ethanol, the palm oil fatty acid isobutyl refers to a palm oil ester-exchange liquid which was obtained by the ester-exchange reaction between a palm oil and iso-butanol, and the soy oil fatty acid octyl refers to a soy oil ester-exchange liquid which was obtained by the ester-exchange reaction between a soy oil and n-octylalcohol.

In Table 1, it is also to be noted that the polyester resin R1 is shown as "R1", the polyester resin R2 is shown as "R2", the polyester resin R3 is shown as "R3", the polyester resin R4 is shown as "R4", the polyester resin R5 is shown as "R5", the polyester resin R6 is shown as "R6", the polyester resin R7 is shown as "R7", and the polyester resin R8 is shown as "R8".

Furthermore, in Table 1, it is also to be noted that methanol is shown as "MeOH", ethanol is shown as "EtOH", isobutanol is shown as "i-BuOH", n-octylalcohol is shown as "OctOH", higholec rape oil (produced by The Nisshin OilliO Group, Ltd.) as oil is shown as "a", COSMO WHITE P-60 (viscosity was 15 mPa·s, produced by COSMO OIL LUBRICANTS CO., Ltd.) as an aliphatic hydrocarbon is shown as "b", DIANAFRESIA W-8 (viscosity was 14 mPa·s, produced by Idemitsu Kosan CO., Ltd.) as an aliphatic hydrocarbon is shown as "c", and the dispersant represented by the above chemical structural formula (VI) is shown as "d".

A part of the toner particles was taken out from the liquid developer in each of the Examples 1 to 8 and the Comparative Examples 1 to 5. Thereafter, a resin material contained in the part of the toner particles was analyzed. The results, that is, the weight-average molecular weight Mw of the resin material, the amount of a component of which molecular weight is 10,000 or less, and Mw/Mn were shown in Table 2.

In each of the Examples 1 to 8 and the Comparative Examples 1 to 5 in Table 2, the analysis of the resin material was carried out as follows. In this regard, it is to be noted that each liquid developer used for the analysis was one obtained after a predetermined time had been elapsed since the production thereof.

First, 200 ml of the liquid developer was taken out from the prepared liquid developer. The 200 ml of the liquid developer was added to a centrifuge tube of a 50 ml size which was made of polypropylene. Then, the liquid developer was subjected to a centrifugation apparatus (relative centrifugal acceleration was 890×3 min) for a solid-liquid separation. Then, the separated liquid, namely a supernatant solution (insulation liquid) was removed by decantation.

Thereafter, ISOPER H (produced by Exxon Mobil Chemical) was added to the obtained solid, namely a residue (toner particles) so that a total amount in the centrifuge tube became 50 ml. Then, the added ISOPER H was stirred with a spatula sufficiently, and was mixed with the residue to obtain a mixture. The mixture was again subjected to the centrifugation apparatus for the solid-liquid separation. Then, the supernatant solution was removed by decantation to obtain the residue as described above. The operations were repeated two times, thereby completely removing the insulation liquid.

Next, the obtained residue was naturally dried for 24 hours. Thereafter, the dried residue was added into a centrifuge tube together with tetrahydrofuran to obtain a solution. The solution was subjected to the centrifugation apparatus so that a component derived from a pigment (residue) was separated with a resin component solution in which the resin material was dissolved.

Then, tetrahydrofuran was added into the resin component solution so that a concentration of a sample (solid matter) became 1 mg/ml. The resin component solution in which the tetrahydrofuran was added was left for a whole day and night. Thereafter, the left resin component solution was filtered by using a syringe filter having pore sizes of 0.2 μm to obtain a filtrate as a sample solution.

Next, the sample solution was subjected to a gel permeation chromatography under the following conditions to obtain a chromatogram of the resin material and an integral distribution curve of the molecular weight of the resin material.

The conditions were set so that High Speed GPC system ("HLC-8220GPC" including R1/UV-8220 produced by TOSOH CORPORATION) was used as an apparatus for the gel permeation chromatography, four columns, namely TSK-gel SuperHZM-Ms (the inside diameter was 4.6 mm, the length was 15 cm) were used, a temperature of each of the four columns was 40° C., and an injection amount of the sample solution was 20 μl.

Thereafter, the integral distribution curve of the molecular weight of the resin material was plotted using a graph in which the ordinate axis represented a relative amount (%) of the resin material with respect to the total amount of the resin material (100%) and the abscissa axis represented the weight-average molecular weight Mw (log) of the resin material.

On the other hand, a plurality of standard material solutions (the standard material was produced by TOSOH CORPORATION) having different weight-average molecular weights was prepared preliminarily. In other words, standard polystyrene solutions having different weight-average molecular weights were prepared preliminarily.

Then, each of the standard polystyrene solutions was subjected to the gel permeation chromatography to obtain a retention time in which each of the plurality of standard polystyrene solutions was eluted in a chromatogram. Thereafter, a calibration curve of the standard polystyrene using a graph in which the ordinate axis represented the weight-average molecular weight and the abscissa axis represented the retention time (min) was plotted.

Then, the weight-average molecular weight of the resin material in the sample solution was obtained using the retention time of the one peak and the calibration curve. As a result, the weight-average molecular weight of the resin material was in the range of 19,000 to 195,000.

Further, the amount of the component of which molecular weight M is 10,000 or less was obtained using the integral distribution curve of the molecular weight of the resin material. As a result, the amount of the component of which molecular weight M is 10,000 or less is in the range of 6 to 42 wt %.

In each of the Examples 1 to 8 and the Comparative Examples 1 to 5 in Table 2, the weight-average molecular weight of the resin material was defined as Mw and an number-average molecular weight of the resin material was defined as Mn. The number-average molecular weight Mn was obtained by the same method as that used for obtaining the weight-average molecular weight Mw.

Table 1

TABLE 1

| | Liquid developer | | | | | | | |
|---|---|---|---|---|---|---|---|---|
| | Toner particles | | | | | | | |
| | Resin material | | | | | | | |
| | Kind | Mw | Amount of compoent of which molecular weight is 10,000 or less [wt %] | Mw/Mn | Tg [° C.] | Tf [° C.] | Tg(ΔTg) [° C.] | Insulation liquid Fatty acid monoester Kind |
| Ex. 1 | R1 | 45,600 | 24.5 | 1.68 | 48 | 108 | 25(−23) | Soy oil fatty acid methyl |
| Ex. 2 | R2 | 36,400 | 38.0 | 25.8 | 46 | 95 | 22(−24) | Soy oil fatty acid methyl |
| Ex. 3 | R1 | 45,600 | 24.5 | 1.68 | 48 | 108 | 25(−23) | Soy oil fatty acid methyl |
| Ex. 4 | R3 | 170,000 | 8.5 | 1.45 | 62 | 110 | 45(−17) | Soy oil fatty acid methyl |
| Ex. 5 | R1 | 45,600 | 24.5 | 1.68 | 48 | 108 | 23(−25) | Laurate ethyl |
| Ex. 6 | R4 | 125,000 | 35.0 | 28.0 | 56 | 98 | 40(−16) | Palm oil fatty acid isobutyl |
| Ex. 7 | R2 | 36,400 | 38.0 | 25.8 | 46 | 95 | 26(−20) | Soy oil fatty acid octyl |
| Ex. 8 | R1 | 45,600 | 24.5 | 1.68 | 48 | 108 | 20(−28) | Soy oil fatty acid methyl |
| Comp. Ex. 1 | R5 | 48,600 | 65.0 | 22.6 | 57 | 110 | 20(−27) | Soy oil fatty acid methyl |
| Comp. Ex. 2 | R6 | 8,900 | 95.0 | 4.2 | 56 | 91 | 26(−30) | Laurate ethyl |
| Comp. Ex. 3 | R7 | 236,000 | 15.0 | 2.8 | 63 | 178 | 53(−10) | Soy oil fatty acid methyl |
| Comp. Ex. 4 | R8 | 78,000 | 4.2 | 1.2 | 60 | 104 | 45(−15) | Soy oil fatty acid methyl |
| Comp. Ex. 5 | R1 | 45,600 | 24.5 | 1.68 | 48 | 108 | 48(0) | — |

TABLE 1-continued

| | Liquid developer Insulation liquid | | | | | |
|---|---|---|---|---|---|---|
| | Fatty acid monoester | | Main component other than fatty acid monoester | | Despersant | |
| | Alcohol component | Amount of fatty acid monoester in insulation liquid: X [wt %] | Kind | Amount of main component other than fatty acid monoester in insulation liquid: Y [wt %] | Kind | Amount of despersant to toner particles of 100 parts by weight [parts by weight] |
| Ex. 1 | MeOH(Carbon number 1) | 38.7 | a | 58.1 | d | 5.0 |
| Ex. 2 | MeOH(Carbon number 1) | 38.7 | a | 58.1 | d | 5.0 |
| Ex. 3 | MeOH(Carbon number 1) | 58.1 | b | 38.7 | d | 5.0 |
| Ex. 4 | MeoH(Carbon number 1) | 38.7 | a | 58.1 | d | 5.0 |
| Ex. 5 | EtOH(Carbon number 2) | 38.7 | b | 58.1 | — | — |
| Ex. 6 | i-BuoH(Carbon number 4) | 48.4 | c | 48.4 | d | 5.0 |
| Ex. 7 | OctOH(Carbon number 8) | 58.1 | b | 38.7 | d | 5.0 |
| Ex. 8 | MeOH(Carbon number 1) | 96.8 | — | — | d | 5.0 |
| Comp. Ex. 1 | MeOH(Carbon number 1) | 38.7 | a | 58.1 | d | 5.0 |
| Comp. Ex. 2 | EtOH(Carbon number 2) | 38.7 | b | 58.1 | d | 5.0 |
| Comp. Ex. 3 | MeOH(Carbon number 1) | 38.7 | a | 58.1 | d | 5.0 |
| Comp. Ex. 4 | MeOH(Carbon number 1) | 39.8 | a | 58.1 | d | 5.0 |
| Comp. Ex. 5 | — | — | a | 96.8 | d | 5.0 |

TABLE 2

| | Resin component of toner particles taken out from liquid developer | | |
|---|---|---|---|
| | Weight-average molecular weight Mw | Amount of component of which molecular weight is 10,000 or less [wt %] | Mw/Mn |
| Ex. 1 | 45,400 | 24.7 | 1.66 |
| Ex. 2 | 46,200 | 38.5 | 25.6 |
| Ex. 3 | 45,300 | 24.7 | 1.65 |
| Ex. 4 | 168,000 | 8.6 | 1.44 |
| Ex. 5 | 45,500 | 24.6 | 1.67 |
| Ex. 6 | 122,000 | 36.0 | 27.5 |
| Ex. 7 | 36,100 | 39.5 | 25.3 |
| Ex. 8 | 44,900 | 25.0 | 1.64 |
| Comp. Ex. 1 | 48,200 | 67.0 | 22.3 |
| Comp. Ex. 2 | 8,800 | 95.2 | 4.1 |
| Comp. Ex. 3 | 234,000 | 16.0 | 2.7 |
| Comp. Ex. 4 | 77,700 | 5.4 | 1.1 |
| Comp. Ex. 5 | 45,900 | 24.0 | 1.65 |

2 Evaluation

For the respective liquid developers produced as described above, the following evaluations were made.

2.1 Fixing Strength (Fixing Characteristics)

By using the image forming apparatus shown in FIG. 1, images each having a predetermined pattern were formed on recording papers (High quality paper LPCPPA4 produced by Seiko Epson Corporation) employing the liquid developers of different colors of the Examples 1 to 8 and the Comparative Examples 1 to 5, respectively. Then, the images formed on the papers were thermally fixed onto the papers using a fixing apparatus as shown in FIG. 4. The thermal fixing was carried out by setting a temperature of a heat fixing roller at 130° C.

Thereafter, after it was confirmed as to whether or not a non-offset area was present, the fixed image on each of the papers was rubbed out twice using a sand eraser ("LION 261-11", Product of LION OFFICE PRODUCTS CORP.) with a pressure loading of 1.2 kgf/cm$^2$. Then, the residual rate of the image density of each recording paper was measured by a calorimeter "X-Rite model 404" (X-Rite Incorporated), and the measurement results were evaluated according to the following five criteria A to E.

A: Residual rate of the image density was 95% or higher (very good).

B: Residual rate of the image density was 90% or higher but lower than 95% (good).

C: Residual rate of the image density was 80% or higher but lower than 90% (normal).

D: Residual rate of the image density was 70% or higher but lower than 80% (bad).

E: Residual rate of the image density was lower than 70% (very bad).

2.2 Fixing Characteristics at Low Temperature

By using the image forming apparatus shown in FIG. 1, images each having a predetermined pattern were formed on recording papers (High quality paper LPCPPA4 produced by Seiko Epson Corporation) employing the liquid developers of different colors of the Examples 1 to 8 and the Comparative Examples 1 to 5, respectively. Then, the images formed on the papers were thermally fixed onto the papers using a fixing apparatus as shown in FIG. 4. The thermal fixing was carried out by setting a temperature of a heat fixing roller at three temperatures of 1100° C., 130° C. and 150° C.

Thereafter, after it was confirmed as to whether or not a non-offset area was present, a mending tape (Product code 810-1-18 produced by Scotch Corporation) was stuck onto the fixed image on each of the recoding papers, which was obtained by carrying out the thermal fixing at the respective three temperatures. Then, the mending tape was peeled off from the paper by pulling the end of the tape to a direction defining an angle of 170° between a surface of the paper and the upper surface of the tape at a speed of 5 cm/s.

Then, the residual rate of the image density of each recording paper was measured by a calorimeter ("X-Rite model 528", produced by X-Rite Incorporated), and the measurement results were evaluated according to the following five criteria A to E.

A: Residual rate of the image density was 95% or higher (very good).

B: Residual rate of the image density was 90% or higher but lower than 95% (good).

C: Residual rate of the image density was 80% or higher but lower than 90% (normal).

D: Residual rate of the image density was 70% or higher but lower than 80% (bad).

E: Residual rate of the image density was lower than 70% (very bad).

2.3 Preservability

The liquid developers obtained in the Examples 1 to 8 and the Comparative Examples 1 to 5 were being placed under the atmosphere in which temperature was changed in the range of 15 to 25° C. for six months. Thereafter, conditions of the toner particles in the liquid developers were visually observed, and the observation results were evaluated by the following five criteria A to E.

A: Suspension of toner particles and aggregation and settling of toner particles were not observed at all.

B; Suspension of toner particles and aggregation and settling of toner particles were scarcely observed.

C: Suspension of toner particles and aggregation and settling of toner particles were slightly observed, but they were within the range where the liquid developer could be practically used.

D: Suspension of toner particles and aggregation and settling of toner particles were clearly observed.

E: Suspension of toner particles and aggregation and settling of toner particles were conspicuously observed.

2.4 Storage Stability

The liquid developers of different colors obtained in the Examples 1 to 8 and the Comparative Examples 1 to 5 were being placed (left) under the atmosphere at a temperature of 35° C. and a relative humidity of 65% for six months. Thereafter, conditions of each of the liquid developers of different colors after the six month period were measured and visually observed, and the measurement and observation results including changes in its viscosity, color, acid numbers, and electric resistance were evaluated by the following five criteria A to E.

In this regard, it is to be noted that the acid numbers of each liquid developer were measured according to JIS K2501. Further, change of color of each liquid developer was visually observed. A viscosity of each liquid developer was measured according to JIS Z8809 using a vibration type viscometer. Electric resistance of each liquid developer was measured by using Universal Electrometer MMAII-17B, electrodes for liquid LP-05, and Sealed Box P-618 (produced by Kawaguchi Electric Works Co., Ltd.).

A: Viscosity change, color change, acid numbers change and electric resistance change of the liquid developers of different colors were not observed at all.

B: Viscosity change, color change, acid numbers change and electric resistance change of the liquid developers of different colors were scarcely observed.

C: Viscosity change, color change, acid numbers change and electric resistance change of the liquid developers of different colors were slightly observed, but they were within the range where the liquid developers could be practically used.

D: Viscosity change, color change, acid numbers change and electric resistance change of the liquid developers of different colors were clearly observed.

E: Viscosity change, color change, acid numbers change and electric resistance change of the liquid developers of different colors were conspicuously observed.

Viscosity

A: Viscosity was 50 mPa·s or higher but 500 mPa·s or lower (very good).

B: Viscosity was 30 mPa·s or higher but 800 mPa·s or lower in which the viscosity of 50 mPa·s or higher but 500 mPa·s or lower was excluded (good).

C: Viscosity was 20 mPa·s or higher but 900 mPa·s or lower in which the viscosity of 30 mPa·s or higher but 800 mPa·s or lower was excluded (acceptable range).

D: Viscosity was lower than 20 mPa·s or higher than 900 mPa·s (bad).

Electric Resistance

A: Electric resistance was $2.0\times10^{12}$ Ωcm or higher (very good).

B: Electric resistance was $1.5\times10^{12}$ Ωcm or higher but lower than $2.0\times10^{12}$ Ωcm (good).

C: Electric resistance was $1.0\times10^{12}$ Ωcm or higher but lower than $1.5\times10^{12}$ Ωcm (acceptable range).

D: Electric resistance was lower than $1.0\times10^{12}$ Ωcm (bad).

2.5 Durability

By using the image forming apparatus shown in FIG. 5, images each having a predetermined pattern were formed on 5,000 recording papers (High quality paper LPCPPA4 produced by Seiko Epson Corporation) employing the liquid developers of the Examples 1 to 8 and the Comparative Examples 1 to 5, respectively.

Then, the images formed on the papers were thermally fixed onto the recoding papers using a fixing apparatus as shown in FIG. 4. The thermal fixing was carried out by setting a temperature of a heat fixing roller at 130C.

Density of two images fixed onto the recording papers was measured by a colorimeter ("X-Rite model 528", produced by X-Rite Incorporated). One image was fixed onto the first recording paper among the 5,000 recording papers, and the image density thereof was defined as ODs. The other image was fixed onto the 5,000th recording paper among the 5,000 recording papers, and the image density thereof was defined as ODe. A maintenance rate of the image density (ODe/ODs×100) was calculated as an index of the durability. The measurement results were evaluated according to the following five criteria A to E.

A: Maintenance rate of the image density was 90% or higher.

B: Maintenance rate of the image density was 80% or higher but lower than 90%.

C: Maintenance rate of the image density was 70% or higher but lower than 80%.

D: Maintenance rate of the image density was 60% or higher but lower than 70%.

E: Maintenance rate of the image density was lower than 60%.

These results are shown in the following Table 3.

Table 3

TABLE 3

| | Characteristics of liquid developer | | | Fixing characteristics | | | | Storage | | |
|---|---|---|---|---|---|---|---|---|---|---|
| | Average particle size of toner particles [μm] | Viscosity | Electric resistance | Fixing strength | Fixing characteristics at low temperature 110° C. | 130° C. | 150° C. | Preservability | stability | Durability |
| Ex. 1 | 1.5 | A | A | A | A | A | A | A | A | A |
| Ex. 2 | 1.4 | A | A | A | A | A | A | B | B | B |
| Ex. 3 | 1.6 | A | A | B | A | A | A | B | A | A |
| Ex. 4 | 1.5 | A | A | B | B | A | A | A | A | A |
| Ex. 5 | 1.6 | A | A | A | A | A | A | B | B | B |
| Ex. 6 | 1.5 | A | A | A | A | A | A | B | A | B |
| Ex. 7 | 1.6 | A | A | B | B | B | A | B | A | B |
| Ex. 8 | 1.4 | B | B | A | A | A | A | B | C | B |
| Comp. Ex. 1 | 1.5 | A | A | D | C | C | B | E | E | E |
| Comp. Ex. 2 | 1.8 | A | A | E | C | C | C | E | E | E |
| Comp. Ex. 3 | 1.5 | A | A | D | E | E | D | C | B | C |
| Comp. Ex. 4 | 1.5 | A | A | C | E | D | D | C | D | E |
| Comp. Ex. 5 | 5.2 | A | A | E | E | E | D | C | B | C |

As shown in the Table 3, the liquid developers according to the present invention (that is, the liquid developers of the Examples 1 to 8) were capable of fixing the images onto the recording papers at a low temperature. Further, even in the case where the images were fixed onto the recording papers at a relatively low temperature, the formed toner images were fixed onto the recording medium firmly. Furthermore, the liquid developers according to the present invention also had excellent storage stability and excellent preservability.

In contrast, in the liquid developers of different colors of the Comparative Examples 1 to 5, satisfactory results could not be obtained.

CROSS-REFERENCE TO RELATED APPLICATION

This application claims priorities to Japanese Patent Applications No. 2007-186262 filed on Jul. 17, 2007 and No. 2008-035327 filed on Feb. 15, 2008 which are hereby expressly incorporated by reference herein in their entireties.

What is claimed is:

1. A liquid developer which comprises an insulation liquid containing a fatty acid monoester, a polymer dispersant and toner particles comprised of a resin material, and the resin material containing a component of which molecular weight M is 10,000 or less, wherein the resin material is characterized in that:

a weight-average molecular weight Mw of the resin material is in the range of 20,000 to 200,000; and an amount of the component contained in the resin material is in the range of 5 to 40 wt %, wherein the polymer dispersant is represented by the following general formula (I):

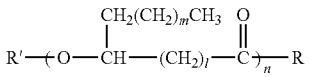

(I)

where I is an integer in the range of 9 to 12, m is an integer in the range of 3 to 6, n is an integer in the range of 5 to 8, R represents —OH, R' represents H— or $CH_3(CH_2)_pCO$—, and p is an integer in the range of 15 to 18.

2. The liquid developer as claimed in claim 1, wherein when the weight-average molecular weight of the resin material is defined as Mw and a number-average molecular weight of the resin material is defined as Mn, Mw/Mn which is an index of a molecular weight distribution of the resin material is in the range of 1,4 to 40.

3. The liquid developer as claimed in claim 1, wherein the resin material has ester bonds in its chemical structure.

4. The liquid developer as claimed in claim 1, wherein the fatty acid monoester is comprised of a fatty acid component and an alcohol component which is reacted with the fatty acid component, wherein the fatty acid component contains a saturated fatty acid monoester of which carbon number is in the range of 8 to 20.

5. The liquid developer as claimed in claim 4, wherein a carbon number of the alcohol component is in the range of 1 to 4.

6. The liquid developer as claimed in claim 1, wherein an amount of the fatty acid monoester contained in the insulation liquid is in the range of 10 to 60 wt %.

7. The liquid developer as claimed in claim 1, wherein an amount of the polymer dispersant contained in the liquid developer is in the range of 1.0 to 10.0 parts by weight with respect to the toner particles of 100 parts by weight.

8. A liquid developer which comprises an insulation liquid containing a fatty acid monoester, a polymer dispersant and toner particles comprised of a resin material, and the resin material containing a component of which molecular weight M is 10,000 or less, wherein the polymer dispersant is represented by the following general formula (I):

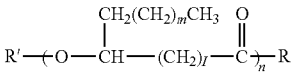

(I)

where I is an integer in the range of 9 to 12, m is an integer in the range of 3 to 6, n is an integer in the range of 5 to 8, R represents —OH, R' represents H— or $CH_3(CH_2)_pCO$—, and p is an integer in the range of 15 to 18, and in the case where a part of the toner particles is taken out from the liquid developer, a weight-average molecular weight Mw of the resin material and an amount of the component are obtained by the following steps, the steps comprising:

subjecting the resin material contained in the part of the toner particles to a size exclusion chromatography to obtain a chromatogram and an integral distribution curve of the molecular weight of the resin material, the chromatogram having at least one peak, and the integral distribution curve plotted using a graph in which the ordinate axis represents a relative amount (%) of the resin material with respect to the total amount of the resin material (100%) and the abscissa axis represents the weight-average molecular weight Mw (log) of the resin material;

analyzing the at least one peak of the obtained chromatogram to obtain a first result which shows that the at least one peak is a peak corresponding to the resin material of which weight-average molecular weight Mw is in the range of 19,000 to 195,000; and analyzing the obtained integral distribution curve to obtain a second result which shows that the amount of the component contained in the resin material is in the range of 5 to 40 wt %.

* * * * *